US009677190B2

(12) United States Patent
Kim et al.

(10) Patent No.: US 9,677,190 B2
(45) Date of Patent: Jun. 13, 2017

(54) MEMBRANE DESIGN FOR REDUCING DEFECTS IN ELECTROPLATING SYSTEMS

(71) Applicant: Lam Research Corporation, Fremont, CA (US)

(72) Inventors: Doyeon Kim, Lake Oswego, OR (US); Shantinath Ghongadi, Tigard, OR (US); Yuichi Takada, Yokohama (JP); Ludan Huang, Tigard, OR (US); Tariq Majid, Wilsonville, OR (US)

(73) Assignee: Lam Research Corporation, Fremont, CA (US)

( * ) Notice: Subject to any disclaimer, the term of this patent is extended or adjusted under 35 U.S.C. 154(b) by 302 days.

(21) Appl. No.: 14/256,770

(22) Filed: Apr. 18, 2014

(65) Prior Publication Data

US 2015/0122658 A1 May 7, 2015

Related U.S. Application Data

(60) Provisional application No. 61/899,111, filed on Nov. 1, 2013.

(51) Int. Cl.
*C25B 13/04* (2006.01)
*B01D 61/48* (2006.01)
(Continued)

(52) U.S. Cl.
CPC ..... *C25D 17/002* (2013.01)

(58) Field of Classification Search
CPC .... C25B 9/08; C25B 9/10; C25B 1/10; C25B 9/00; C25B 13/02; C25B 9/16; C25B 1/46; C02F 2201/46115; C02F 2001/425; B01D 61/48; B01D 2317/08; B01D 2325/42; B01D 2325/14; C25C 7/04
(Continued)

(56) References Cited

U.S. PATENT DOCUMENTS 3,450,625 A 6/1969 Ramsey et al.
3,652,442 A 3/1972 Powers et al.
(Continued)

FOREIGN PATENT DOCUMENTS

EP 0 037 325 3/1981
JP 59-162298 9/1984
(Continued)

OTHER PUBLICATIONS

U.S. Appl. No. 09/872,340, filed May 31, 2001, entitled "Methods and Apparatus for Bubble Removal in Water Wet Processing".
(Continued)

*Primary Examiner* — Zulmariam Mendez
(74) *Attorney, Agent, or Firm* — Weaver Austin Villeneuve & Sampson LLP

(57) ABSTRACT

Certain embodiments disclosed herein pertain to methods and apparatus for electrodepositing material on a substrate. More particularly, a novel membrane for separating the anode from the cathode/substrate, and a method of using such a membrane are presented. The membrane includes at least an ion exchange layer and a charge separation layer. The disclosed embodiments are beneficial for maintaining relatively constant concentrations of species in the electrolyte over time, especially during idle (i.e., non-electroplating) times.

23 Claims, 12 Drawing Sheets

(51) Int. Cl.

| | |
|---|---|
| ***C25B 9/00*** | (2006.01) |
| ***C25B 9/10*** | (2006.01) |
| ***C25B 9/08*** | (2006.01) |
| ***C25C 7/04*** | (2006.01) |
| ***C25D 17/00*** | (2006.01) |

(58) Field of Classification Search
USPC ..... 204/242, 252, 525, 637; 205/520, 523, 205/748
See application file for complete search history.

(56) References Cited

U.S. PATENT DOCUMENTS

| | | | | |
|---|---|---|---|---|
| 3,706,651 | A | | 12/1972 | Leland |
| 3,862,891 | A | | 1/1975 | Smith |
| 4,033,833 | A | | 7/1977 | Bestel et al. |
| 4,035,278 | A | | 7/1977 | Wilkinson et al. |
| 4,073,708 | A | | 2/1978 | Hicks, Jr. |
| 4,082,638 | A | | 4/1978 | Jumer |
| 4,240,886 | A | | 12/1980 | Hodges et al. |
| 4,272,335 | A | | 6/1981 | Combs |
| 4,304,641 | A | | 12/1981 | Grandia et al. |
| 4,469,564 | A | | 9/1984 | Okinaka et al. |
| 4,545,877 | A | | 10/1985 | Hillis |
| 4,604,177 | A | | 8/1986 | Sivilotti |
| 4,604,178 | A | | 8/1986 | Fiegener et al. |
| 4,605,482 | A | | 8/1986 | Shirgami et al. |
| 4,696,729 | A | | 9/1987 | Santini |
| 4,828,654 | A | | 5/1989 | Reed |
| 4,906,346 | A | | 3/1990 | Hadersbeck et al. |
| 4,931,149 | A | | 6/1990 | Stierman et al. |
| 4,933,061 | A | | 6/1990 | Kulkarni et al. |
| 5,039,381 | A | | 8/1991 | Mullarkey |
| 5,096,550 | A | | 3/1992 | Mayer et al. |
| 5,146,136 | A | | 9/1992 | Ogura et al. |
| 5,156,730 | A | | 10/1992 | Bhatt et al. |
| 5,162,079 | A | | 11/1992 | Brown |
| 5,217,586 | A | | 6/1993 | Datta et al. |
| 5,316,642 | A | | 5/1994 | Young, Jr. et al. |
| 5,368,711 | A | | 11/1994 | Poris |
| 5,391,285 | A | | 2/1995 | Lytle et al. |
| 5,421,987 | A | | 6/1995 | Tzanavaras et al. |
| 5,443,707 | A | | 8/1995 | Mori |
| 5,472,592 | A | | 12/1995 | Lowery |
| 5,476,578 | A | | 12/1995 | Forand et al. |
| 5,498,325 | A | | 3/1996 | Nishimura et al. |
| 5,516,412 | A | | 5/1996 | Andricacos et al. |
| 5,567,300 | A | | 10/1996 | Datta et al. |
| 5,910,237 | A | * | 6/1999 | Moulton ..... B01D 61/44 204/522 |
| 5,935,402 | A | | 8/1999 | Fanti |
| 6,027,631 | A | | 2/2000 | Broadbent |
| 6,126,798 | A | | 10/2000 | Reid et al. |
| 6,132,587 | A | | 10/2000 | Jorne |
| 6,193,860 | B1 | | 2/2001 | Weling |
| 6,251,255 | B1 | | 6/2001 | Copping et al. |
| 6,368,475 | B1 | | 4/2002 | Hanson et al. |
| 6,391,166 | B1 | | 5/2002 | Wang |
| 6,391,188 | B1 | | 5/2002 | Goosey |
| 6,395,152 | B1 | | 5/2002 | Wang |
| 6,402,923 | B1 | | 6/2002 | Mayer et al. |
| 6,497,801 | B1 | | 12/2002 | Woodruff et al. |
| 6,527,920 | B1 | | 3/2003 | Mayer et al. |
| 6,755,954 | B2 | | 6/2004 | Mayer |
| 6,773,571 | B1 | | 8/2004 | Mayer et al. |
| 6,821,407 | B1 | | 11/2004 | Reid et al. |
| 6,890,416 | B1 | | 5/2005 | Mayer et al. |
| 6,964,792 | B1 | | 11/2005 | Mayer et al. |
| 7,232,513 | B1 | | 6/2007 | Webb et al. |
| 7,622,024 | B1 | | 11/2009 | Mayer et al. |
| 8,262,871 | B1 | | 9/2012 | Mayer et al. |
| 8,540,857 | B1 | | 9/2013 | Mayer et al. |
| 2003/0029527 | A1 | | 2/2003 | Yajima et al. |
| 2003/0102210 | A1 | | 6/2003 | Woodruff |
| 2004/0007473 | A1 | * | 1/2004 | Yang ..... C25D 17/002 205/291 |
| 2008/0277287 | A1 | * | 11/2008 | Dopp ..... C25B 1/04 205/348 |
| 2010/0032303 | A1 | | 2/2010 | Reid et al. |
| 2010/0032310 | A1 | | 2/2010 | Reid et al. |
| 2010/0116672 | A1 | | 5/2010 | Mayer et al. |
| 2010/0147679 | A1 | | 6/2010 | Feng et al. |

FOREIGN PATENT DOCUMENTS

| | | | | |
|---|---|---|---|---|
| JP | 09-53197 | | 2/1997 | |
| JP | 2001-316887 | | 11/2001 | |
| JP | 2004-63249 | * | 2/2004 | ..... C25B 13/04 |
| WO | WO 99/41434 | | 8/1999 | |

OTHER PUBLICATIONS

US Office Action, dated May 22, 2002, issued in U.S. Appl. No. 09/706,272.
US Notice of Allowance, dated Oct. 29, 2002, issued in U.S. Appl. No. 09/706,272.
US Office Action, dated Sep. 28, 2004, issued in U.S. Appl. No. 10/318,497.
US Notice of Allowance, dated Jan. 6, 2005, issued in U.S. Appl. No. 10/318,497.
US Office Action, dated Jun. 10, 2004, issued in U.S. Appl. No. 10/231,147.
US Notice of Allowance, dated Sep. 7, 2004, issued in U.S. Appl. No. 10/231,147.
US Office Action, dated Dec. 23, 2011, issued in U.S. Appl. No. 12/640,992.
US Final Office Action, dated Mar. 27, 2012, issued in U.S. Appl. No. 12/640,992.
US Notice of Allowance, dated May 30, 2012, issued in U.S. Appl. No. 12/640,992.
US Office Action, dated Apr. 1, 2013, issued in U.S. Appl. No. 13/571,199.
US Notice of Allowance, dated Jun. 17, 2013, issued in U.S. Appl. No. 13/571,199.
Fang, et al. (2004) "Uniform Copper Electroplating on Resistive Substrates," Abs. 167, 205$^{th}$ Meeting, *The Electrochemical Society*, Inc., 1 page.
Peeva et al. (2010) "Nanofiltration Operations in Nonaqueous Systems," *Imperial College London*, London, UK, 8 pages.
Takagishi et al., (1984) "The Binding of Organic Anions by Polyvinylpyrrolidone: Determination of Intrinsic Binding Constant and Number of Binding Sites by Competitive Binding," *Journal of Polymer Science: Polymer Chemistry Edition*, 22:185-194.

* cited by examiner

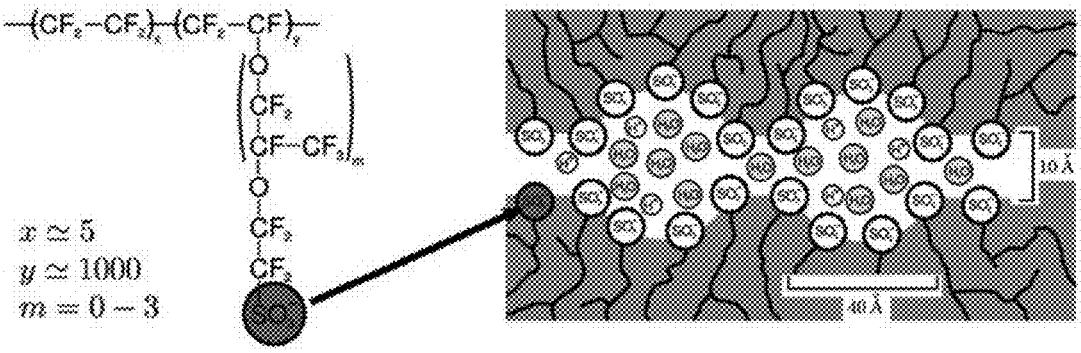
FIG. 1
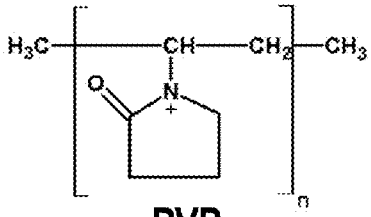
PVP
FIG. 2A
| Estimated Molecular Radius (nm) | Estimated Molecular Weight[b] |
|---|---|
| 1.6–1.8 | 6,500–8,500 |
| 1.8–2.0 | 8,500–10,500 |
| 2.0–2.5 | 10,500–16,000 |
| 2.5–3.1 | 16,000–25,000 |
| 3.1–4.0 | 25,000–41,500 |
| 4.0–5.1 | 41,500–67,500 |
| 5.1–6.6 | 67,500–113,500 |
| 6.6–9.0 | 113,500–211,000 |
FIG. 2B

Means and Std Deviations

| Membrane | Mean | Std Dev | Lower 90% | Upper 90% |
|---|---|---|---|---|
| Conv. | 25.9333 | 32.9880 | 10.9314 | 40.935 |
| Improved | 8.8125 | 3.5631 | 7.2509 | 10.374 |

MEMBRANE DESIGN FOR REDUCING DEFECTS IN ELECTROPLATING SYSTEMS

CROSS-REFERENCE TO RELATED APPLICATION

This application claims benefit of priority to U.S. Provisional Application No. 61/899,111, filed Nov. 1, 2013, and titled "MEMBRANE DESIGN FOR REDUCING DEFECTS IN ELECTROPLATING SYSTEMS," which is incorporated herein by reference in its entirety and for all purposes.

BACKGROUND

Manufacturing of semiconductor devices commonly requires deposition of electrically conductive materials on semiconductor wafers. The conductive material, such as copper, is often deposited by electroplating onto a seed layer of metal deposited onto the wafer surface by a physical vapor deposition (PVD) or chemical vapor deposition (CVD) method. Electroplating is a method of choice for depositing metal into the vias and trenches of the wafer during damascene and dual damascene processing. To meet the demands of modern semiconductor processing, the electrically conductive material deposited on the surface of a semiconductor wafer needs to have the lowest possible defect density.

Damascene processing is a method for forming interconnections on integrated circuits (ICs). It is especially suitable for manufacturing integrated circuits, which employ copper as a conductive material. Damascene processing involves formation of inlaid metal lines in trenches and vias formed in a dielectric layer (inter-metal dielectric). In a typical damascene process, a pattern of trenches and vias is etched in the dielectric layer of a semiconductor wafer substrate. Typically, a thin layer of an adherent metal diffusion-barrier film such as tantalum, tantalum nitride, or a TaN/Ta bilayer is then deposited onto the wafer surface by a PVD method, followed by deposition of electroplate-able metal seed layer (e.g., copper, nickel, cobalt, ruthenium, etc.) on top of the diffusion-barrier layer. The trenches and vias are then electrofilled with copper, and the surface of the wafer is planarized. Other types of electroplating processes may include wafer level packaging (WLP) and through-silicon-via (TSV) processes, for example.

A typical electroplating apparatus includes a reaction vessel that houses electrolyte, a substrate (which acts as the cathode) and an anode. Certain electroplating systems employ a porous barrier between the substrate and the anode. This barrier is often, but not always, a cationic exchange membrane which permits the passage of small positively charged species and blocks the passage of negatively charged species and any relatively large species. One advantage to using a membrane between the anode and substrate is that different chemistries may be used for the anolyte and catholyte. For example, it may be desirable to include certain plating additives (e.g., organic plating additives such as accelerator, suppressor and leveler) in the catholyte, while maintaining the anolyte free of such additives. It is generally desirable to ensure that the anolyte does not include plating additives in order to prevent the additives from coming into contact with the anode where they may be degraded to form defect-inducing species.

Unfortunately, in certain cases the membrane can adsorb species present in the catholyte (and/or anolyte in some cases). This blockage by adsorption can lead to the failure of an electroplating process. As such, there exists a need for an improved membrane that better resists becoming blocked.

SUMMARY

Certain embodiments herein relate to methods and apparatus for electroplating material onto a substrate. The substrate may be a partially fabricated semiconductor substrate. In many cases, an electroplating apparatus includes a membrane separating a cathode chamber from an anode chamber. Typically, the substrate acts as the cathode and resides in the cathode chamber, surrounded by catholyte. An anode is positioned in the anode chamber and surrounded by anolyte. The membrane maintains separation between the anolyte and catholyte, permitting different compositions of electrolyte to be used in each chamber. For instance, organic additives (e.g., accelerator, suppressor, and leveler) may be included in the catholyte and omitted from the anolyte, where they could cause plating problems. Various embodiments herein utilize an improved membrane that includes both an ion exchange layer as well as a charge separation layer. The charge separation layer may help prevent species in the electrolyte from adsorbing onto the membrane. Such prevention helps simplify maintenance of the electrolyte and promote uniform plating results with low defects.

In one aspect of the disclosed embodiments, an apparatus for electroplating material on to a substrate is provided, including a reaction vessel including a cathode chamber and an anode chamber, the cathode chamber configured to hold catholyte during electroplating and the anode configured to hold anolyte and an anode during electroplating; a membrane in the reaction vessel separating the cathode chamber from the anode chamber, the membrane including an ion exchange layer and a charge separation layer, where the charge separation layer is at least about 150 μm thick, and where the membrane has a molecular weight cut off between about 200-1500 Da; and a substrate support mechanism for supporting the substrate in the reaction vessel such that the substrate is exposed to the catholyte in the cathode chamber during electroplating.

In some embodiments, the charge separation layer may be between about 150-1000 μm thick. The charge separation layer may have a molecular weight cutoff between about 200-1000 Da. The charge separation layer may have an average pore diameter of about 1 nm or less. In some cases, the charge separation layer includes one or more materials selected from the group consisting of: polysulfone, polyethersulfone, polyetheretherketone, cellulose acetate, cellulose ester, polyacrylonitrile, polyvinylidene fluoride, polyimide, polyetherimide, aliphatic polyamide, polyethylene, polypropylene, polytetrafluoroethylene, and silicone. Further, in various embodiments the charge separation layer is stable in acidic electrolyte. The charge separation layer may include a nanofiltration material, and in some cases includes MPF-34, a membrane available from Koch Membrane of Wilmington, Mass.

Various materials and designs may be used for the ion exchange layer. In some cases, the ion exchange layer may be a cationic exchange layer. In other cases, the ion exchange layer may be an anionic exchange layer. In certain embodiments, the ion exchange layer includes a cationic exchange material such as NAFION® from Wilmington, Del. The ion exchange layer may be between about 10-100 μm thick in some cases. In other cases, the ion exchange layer may be thicker than this range.

Typically, the charge separation layer is positioned between the ion exchange layer and the electrolyte that contains a species likely to adsorb onto/into the ion exchange layer. Where the adsorbing species is a leveler or other additive/component in the catholyte, the charge separation layer may face the cathode chamber and the ion exchange layer may face the anode chamber. In contrast, where the adsorbing species is a component of the anolyte, the charge separation layer may face the anode chamber and the ion exchange layer may face the cathode chamber. In certain embodiments, the membrane may further include a second charge separation layer. The charge separation layer may contact a first side of the ion exchange layer, and the second charge separation layer may contact a second side of the ion exchange layer, such that the membrane has a sandwich structure with the ion exchange layer between two charge separation layers.

In another aspect of the embodiments herein, a method is provided for electroplating material onto a substrate. The method may include providing a substrate in a reaction vessel including a cathode chamber, an anode chamber, and a membrane separating the cathode chamber from the anode chamber, where the membrane includes an ion exchange layer and a charge separation layer, where the charge separation layer is at least about 150 μm thick and has a molecular weight cutoff between about 200-1500 Da, and where the substrate contacts catholyte in the cathode chamber; and electroplating material onto the substrate.

In some embodiments, the ion exchange layer includes pores having an average diameter, the surface of the pores including positively or negatively charged groups. At least one of the anolyte and catholyte may include an adsorbing species having a charge that is opposite the charge of the charged groups in the pores. The adsorbing species may have an average molecular diameter between about 50-150% of the average diameter of the pores. In some cases, the adsorbing species includes a leveler. For example, the adsorbing species may include polyvinylpyrrolidone leveler. In these or other cases, the charged groups on the surface of the pores may include $SO_3^-$.

As noted above, the charge separation layer and ion exchange layer may be positioned in various ways. In some cases, the charge separation layer faces the cathode chamber and the ion exchange layer faces the anode chamber. This is especially relevant when the catholyte contains a species likely to be adsorbed in/on the ion exchange layer. In other cases, the charge separation layer faces the anode chamber and the ion exchange layer faces the cathode chamber. This is relevant when the anolyte contains a species likely to be adsorbed in/on the ion exchange layer. In still other cases, a second charge separation layer may be used, and the ion exchange layer may be sandwiched between the two charge separation layers. This may be particularly useful for cases where both the anolyte and catholyte contain species likely to adsorb onto an ion exchange layer, and for cases where a symmetric membrane is desired. A symmetric membrane is advantageous because it cannot be accidentally placed into an electroplating apparatus upside down.

In many cases, the method is repeated to electroplate material onto a plurality of substrates, where there is an idle period between electroplating subsequent substrates. A voltage profile during electroplating may be substantially uniform between electroplating on subsequent substrates. In some cases, the idle period between electroplating subsequent substrates is at least about 6 hours, and a resistance of the membrane does not increase by more than about 25% during the idle period. In a particular embodiment, the ion exchange layer may include pores having charged groups, where at least one of the anolyte and catholyte include an adsorbing species having a charge that is opposite the charge of the charged groups in the pores, where the idle period between electroplating subsequent substrates is at least about 1 hour, and where a concentration of adsorbing species in the anolyte or catholyte does not decrease by more than about 8% during the idle period.

In another aspect of the disclosed embodiments, a method of idling an electrodeposition apparatus is provided, including: idling an electrodeposition apparatus including a reaction vessel including a cathode chamber, an anode chamber, and a membrane separating the cathode chamber from the anode chamber, where the membrane includes an ion exchange layer and a charge separation layer, the charge separation layer having a thickness of at least about 150 μm and a molecular weight cutoff between about 200-1500 Da, and where the cathode chamber includes catholyte and the anode chamber includes anolyte.

The ion exchange layer may include pores having an average diameter, the surface of the pores including positively or negatively charged groups, and where at least one of the anolyte and catholyte includes an adsorbing species having a charge that is opposite the charge of the charged groups in the pores, the adsorbing species having an average molecular diameter between about 50-150% of the average diameter of the pores. In some cases, after idling for a period of at least about 6 hours, a resistance of the membrane does not increase by more than about 25%. The adsorbing species may be a leveler in some cases, and in a particular implementation is polyvinylpyrrolidone. The charged groups on the surface of the pores may include $SO_3^-$. In some cases, after idling for a period of at least about 12 hours, the resistance of the membrane does not increase by more than about 15%.

These and other features will be described below with reference to the associated drawings.

BRIEF DESCRIPTION OF THE DRAWINGS

FIG. 1 illustrates the interior region of a pore in a cationic membrane.

FIG. 2A shows the structure of polyvinylpyrrolidone, a component of certain leveler solutions.

FIG. 2B is a table relating the estimated molecular radius and estimated molecular weight for polyvinylpyrrolidone.

DETAILED DESCRIPTION

Figure 2C:
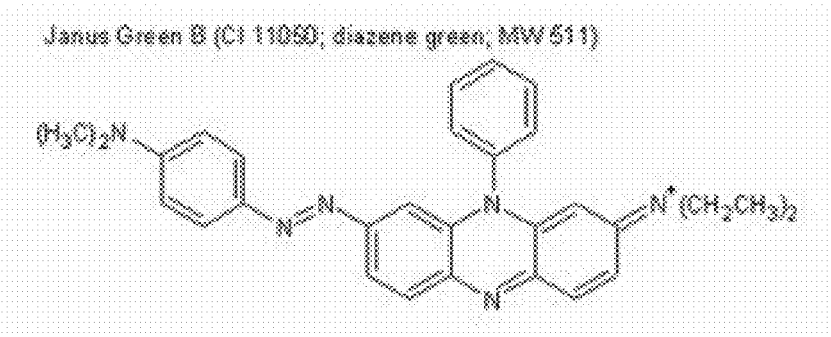
FIG. 2C shows the structure of Janus Green B.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 150 mm, 200 mm, or 300 mm, or 450 mm. Further, the terms "electrolyte," "plating bath," "bath," and "plating solution" are used interchangeably. The following detailed description assumes the invention is implemented on a wafer. However, the invention is not so limited. The work piece may be of various shapes, sizes, and materials. In addition to semiconductor wafers, other work pieces that may take advantage of this invention include various articles such as printed circuit boards and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

In certain membranes, the transport of cationic species through the membrane is promoted by including negatively charged functional groups in the membrane material. Unfortunately, under certain circumstances the membrane can adsorb species from the catholyte (or anolyte). Species that are especially likely to be adsorbed by a membrane include those having a positive charge (or positively charged portion) that are of similar size to the pores in the membrane. In some cases, the problematic species is one or more of the organic plating additives. Adsorption of species onto/into a membrane may cause the resistance of the membrane to increase. Adsorption may also cause blockage within the pores of the membrane.

Organic plating additives are often used to promote a bottom-up filling mechanism of a recessed feature. Three main types of additives include suppressors, accelerators and levelers.

Suppressors

While not wishing to be bound to any theory or mechanism of action, it is believed that suppressors (either alone or in combination with other bath additives) are surface-kinetic polarizing compounds that lead to a significant increase in the voltage drop across the substrate-electrolyte interface, especially when present in combination with a surface chemisorbing halide (e.g., chloride or bromide). The halide may act as a bridge between the suppressor molecules and the wafer surface. The suppressor both (1) increases the local polarization of the substrate surface at regions where the suppressor is present relative to regions where the suppressor is absent, and (2) increases the polarization of the substrate surface generally. The increased polarization (local and/or global) corresponds to increased resistivity/impedance and therefore slower plating at a particular applied potential.

It is believed that suppressors are not incorporated into the deposited film, though they may slowly degrade over time. Suppressors are often relatively large molecules, and in many instances they are polymeric in nature (e.g., polyethylene oxide, polypropylene oxide, polyethylene glycol, polypropylene glycol, etc). Other examples of suppressors include polyethylene and polypropylene oxides with S- and/or N-containing functional groups, block polymers of polyethylene oxide and polypropylene oxides, etc. The suppressors can have linear chain structures or branch structures. It is common that suppressor molecules with various molecular weights co-exist in a commercial suppressor solution. Due in part to suppressors' large size, the diffusion of these compounds into a recessed feature is relatively slow.

Accelerators

While not wishing to be bound by any theory or mechanism of action, it is believed that accelerators (either alone or in combination with other bath additives) tend to locally reduce the polarization effect associated with the presence of suppressors, and thereby locally increase the electrodeposition rate. The reduced polarization effect is most pronounced in regions where the adsorbed accelerator is most concentrated (i.e., the polarization is reduced as a function of the local surface concentration of adsorbed accelerator). Example accelerators include, but are not limited to, dimercaptopropane sulfonic acid, dimercaptoethane sulfonic acid, mercaptopropane sulfonic acid, mercaptoethane sulfonic acid, bis-(3-sulfopropyl) disulfide (SPS), and their derivatives. Although the accelerator may become strongly adsorbed to the substrate surface and generally laterally-surface immobile as a result of the plating reactions, the accelerator is generally not incorporated into the film. Thus, the accelerator remains on the surface as metal is deposited. As a recess is filled, the local accelerator concentration increases on the surface within the recess. Accelerators tend to be smaller molecules and exhibit faster diffusion into recessed features, as compared to suppressors.

Levelers

While not wishing to be bound by any theory or mechanism of action, it is believed that levelers (either alone or in combination with other bath additives) act as suppressing agents to counteract the depolarization effect associated with accelerators, especially in the field region and at the side walls of a feature. The leveler may locally increase the polarization/surface resistance of the substrate, thereby slowing the local electrodeposition reaction in regions where the leveler is present. The local concentration of levelers is determined to some degree by mass transport. Therefore levelers act principally on surface structures having geometries that protrude away from the surface. This action "smoothes" the surface of the electrodeposited layer. It is believed that leveler reacts or is consumed at the substrate surface at a rate that is at or near a diffusion limited rate, and therefore, a continuous supply of leveler is often beneficial in maintaining uniform plating conditions over time.

Leveler compounds are generally classified as levelers based on their electrochemical function and impact and do not require specific chemical structure or formulation. However, levelers often contain one or more nitrogen, amine, imide or imidazole, and may also contain sulfur functional groups. Certain levelers include one or more five and six member rings and/or conjugated organic compound derivatives. Nitrogen groups may form part of the ring structure. In amine-containing levelers, the amines may be primary, secondary or tertiary alkyl amines. Furthermore, the amine may be an aryl amine or a heterocyclic amine. Example amines include, but are not limited to, dialkylamines, trialkylamines, arylalkylamines, triazoles, imidazole, triazole, tetrazole, benzimidazole, benzotriazole, piperidine, morpholines, piperazine, pyridine, oxazole, benzoxazole, pyrimidine, quonoline, and isoquinoline. Imidazole and pyridine may be especially useful. Leveler compounds may also include ethoxide groups. For example, the leveler may include a general backbone similar to that found in polyethylene glycol or polyethyelene oxide, with fragments of amine functionally inserted over the chain (e.g., Janus Green B). Example epoxides include, but are not limited to, epihalohydrins such as epichlorohydrin and epibromohydrin, and polyepoxide compounds. Polyepoxide compounds having two or more epoxide moieties joined together by an ether-containing linkage may be especially useful. Some leveler compounds are polymeric, while others are not. Example polymeric leveler compounds include, but are not limited to, polyethylenimine, polyamidoamines, and reaction products of an amine with various oxygen epoxides or sulfides. One example of a non-polymeric leveler is 6-mercapto-hexanol. Another example leveler is polyvinylpyrrolidone (PVP).

Bottom-Up Fill

In the bottom-up fill mechanism, a recessed feature on a plating surface tends to be plated with metal from the bottom to the top of the feature, and inward from the side walls towards the center of the feature. It is important to control the deposition rate within the feature and in the field region in order to achieve uniform filling and avoid incorporating voids into the features. The three types of additives described above are beneficial in accomplishing bottom-up fill, each working to selectively increase or decrease the polarization at the substrate surface.

After the substrate is immersed in electrolyte, the suppressor adsorbs onto the surface of the substrate, especially in exposed regions such as the field region. At the initial plating stages, there is a substantial differential in suppressor concentration between the top and bottom of a recessed feature. This differential is present due to the relatively large size of the suppressor molecule and its correspondingly slow transport properties. Over this same initial plating time, it is believed that accelerator accumulates at a low, substantially uniform concentration over the entire plating surface, including the bottom and side walls of the feature. Because the accelerator diffuses into features more rapidly than the suppressor, the initial ratio of accelerator:suppressor within the feature (especially at the feature bottom) is relatively high. The relatively high initial accelerator:suppressor ratio within the feature promotes rapid plating from the bottom of the feature upwards and from the sidewalls inwards. Meanwhile, the initial plating rate in the field region is relatively low due to the lower ratio of accelerator:suppressor. Thus, in the initial plating stages, plating occurs relatively faster within the feature and relatively slower in the field region.

As plating continues, the feature fills with metal and the surface area within the feature is reduced. Because of the decreasing surface area and the accelerator substantially remaining on the surface, the local surface concentration of accelerator within the feature increases as plating continues. This increased accelerator concentration within the feature helps maintain the differential plating rate beneficial for bottom-up fill.

In the later stages of plating, particularly as overburden deposits, the accelerator may build up in certain regions (e.g., above filled features) undesirably, resulting in local faster-than-desired plating. Leveler may be used to counteract this effect. The surface concentration of leveler is greatest at exposed regions of a surface (i.e., not within recessed features) and where convection is greatest. It is believed that the leveler displaces accelerator, increases the local polarization and decreases the local plating rate at regions of the surface that would otherwise be plating at a rate greater than at other locations on the deposit. In other words, the leveler tends, at least in part, to reduce or remove the influence of an accelerating compound at the exposed regions of a surface, particularly at protruding structures. Without leveler, a feature may tend to overfill and produce a bump. Therefore, in the later stages of bottom-up fill plating, levelers are beneficial in producing a relatively flat deposit.

The use of suppressor, accelerator and leveler, in combination, may allow a feature to be filled without voids from the bottom-up and from the sidewalls-inward, while producing a relatively flat deposited surface. The exact identity/composition of the additive compounds are typically maintained as trade secrets by the additive suppliers, thus, information about the exact nature of these compounds is not publicly available.

Membrane Adsorption/Blockage Issues

As mentioned above, in certain cases a membrane separating the anolyte and catholyte becomes blocked due to species in the catholyte (or anolyte) adsorbing onto the membrane. The adsorption is more likely to occur during periods in which an electroplating system is idle, compared to when it is actually plating. During an electroplating process, positively charged species (i.e., those that could potentially adsorb onto a cationic exchange membrane) in the catholyte move towards the cathode where they are unlikely to cause problems within the membrane. During idle times when there is no electric field applied, the species in the catholyte can move more freely within the cathode chamber, and may end up diffusing to the membrane and clogging the membrane pores over time. Also, the membrane adsorbs the species driven by electrostatic/Van de Waals interaction. Some embodiments are performed while the electroplating system is idling. An electroplating system is considered to be idle/idling when no electroplating or other major physical operations (e.g., cleaning) are taking place. Substrates may be transferred into and out of an electroplating apparatus during an idle period. Further, electrolyte (catholyte and/or anolyte) may be circulating during an idle period. In many cases, the apparatus idles while electrolyte is present in the reaction vessel. As discussed, the membrane may be present in the vessel during such idle periods.

As a membrane adsorbs leveler, the resistance of the membrane increases. The increased resistance arises because when the membrane pores are blocked with adsorbed species, ionic transfer through the membrane is inhibited. Also, leveler adsorption creates uneven current density across the substrate. When an electroplating process is initiated after an idle period, the membrane is likely to have a larger resistance than it had during previous electroplating processes. In some cases, the increase in resistance is substantial, and can cause a power supply to malfunction during the next plating process, especially during delivery of a high current (e.g., about 40 A for plating a 300 mm diameter wafer). In some electroplating processes, the cell applies variable magnitude current over the course of deposition. The highest currents may be applied during deposition of a bulk film/overburden. In certain cases where a NAFION® membrane is used, an acceptable membrane resistance may be about 0.00116 ohm/cm$^2$, and the resistance corresponding to a blocked membrane may be about 0.00146 ohm/cm$^2$ (an increase of about 25%). The increased resistance may result in a high magnitude voltage spike, which is especially likely to occur at the initiation of the overburden stage during deposition. While it is not uncommon for the voltage to peak at this stage, the voltage peak should be relatively uniform between wafers, and unexpectedly high magnitude peak voltages (or currents) can indicate blockage problems within the membrane. In some cases, the voltage spike is so great that it causes the voltage to exceed a limit set on the power supply, which may cause the electroplating process to fail. The failure of a power supply in this manner is an indication that a membrane may be blocked. Further indications of membrane blockage/adsorption include inconsistent current and voltage performance during deposition (as compared to similar/identical deposition processes run on other wafers), as mentioned above.

Species that are more likely to adsorb onto and potentially block a membrane include those that have a charge opposite that of the functional groups present in the membrane, and which are sized similarly to the pore size in the membrane. As used herein, charge/charged may refer to the overall charge of a molecule, or to the polarity of a portion of a molecule. In certain cases, the membrane is a cationic exchange membrane that includes negatively charged functional groups within the membrane. Examples of negatively charged groups include —$SO_3^-$, —$COO^-$, —$PO_3^{2-}$, —$PO_3H^-$, and —$C_6H_4O^-$. In this case, positively charged species present in the catholyte and/or anolyte may become lodged in the membrane if they are of similar size to the membrane pores. As used herein, "similar size" means that a molecular diameter of the adsorbing/blocking species is between about 50-150% of a diameter of the pores. An anionic exchange membrane includes positively charged functional groups within the membrane. Examples of such positively charged groups include —$NH_3^+$, —$NRH_2^+$, —$NR_2H^+$, —$NR_3^+$, —$SR_2^+$. Where an anionic selective membrane is used, negatively charged species that are of similar size to the membrane pores may similarly become lodged on or within the membrane pores.

One example of where this problem occurs is an electroplating system using a NAFION® cationic exchange membrane in conjunction with a polyvinylpyrrolidone-containing leveler. While certain implementations are described in this context, the embodiments are not so limited. The disclosed embodiments may be used with both cationic exchange membranes and anionic exchange membranes, and with any type of charged (or partially charged) adsorbing/blocking species. NAFION® membranes are available from DuPont of Wilmington, Del. As shown in FIG. 1, the NAFION® membrane includes terminal $SO_3^-$ functional groups throughout the membrane, especially on the surfaces of the pores. FIG. 2A shows the structure of polyvinylpyrrolidone (PVP). When PVP is introduced to an aqueous solution, the nitrogen of the PVP achieves a high positive polarity/charge, as indicated by the + in FIG. 2A. This positive charge is fairly strong. FIG. 2B is a table showing the estimated molecular weight of PVP having different molecular radii. "The Binding of Organic Anions by Polyvinylpyrrolidone: Determination of Intrinsic Binding Constant and Number of Binding Sites by Competitive Binding," by Toni Takagishi, et al., Journal of Polymer Science: Polymer Chemistry Edition, Vol. 22, 185-194 (1984), which is herein incorporated by reference in its entirety, further discusses the attraction between PVP and negatively charged groups.

FIG. 2C provides the structure of Janus Green B, a leveler commonly used in electroplating processes. Although this leveler includes a nitrogen having a positive charge, it does not experience clogging problems within the membrane pores. One reason for this may be that although the nitrogen is positively charged, this charge is fairly weak. All cationic membranes have shown blockage problems when used with PVP-containing leveler, as indicated by a decrease in leveler concentration during idle times. Non-cationic membranes have not shown such problems.

Problematic compounds that are likely to become trapped in and block a membrane may share certain properties. For example, when used in combination with a cationic exchange layer, compounds that have acidic or weakly basic groups are more likely to be problematic. These groups may act as proton donors/Lewis acids. Problematic compounds may have one or more nitrogen atoms that are acidic or weakly basic. The problematic compound may have a nitrogen atom that is hybridized. In some cases, a problematic compound will include one or more aromatic rings that include nitrogen. For example, the problematic compound may include an aromatic ring with a nitrogen in a first position on the ring and a strong electron withdrawing group in a second position on the ring (e.g., a carbonyl group). The first and second position on the ring may be adjacent. In some embodiments, the problem causing compound includes a pyrrolidone ring, a pyridine ring, a pyrimidine ring, a pyrrole ring, and/or an imidazole ring. In certain cases, the problem causing compound may be provided as a polymer having a molecular weight or average molecular weight between about 300-5000 Da, or between about 1000-5000 Da, or between about 3000-5000 Da. These characteristics are exemplary and are not intended to be limiting. In various cases, the problem causing compound does not meet one or more of the listed characteristics.

Examples of leveler compounds that may adsorb and cause blockage of a membrane are further discussed and described in the following patent application, which is herein incorporated by reference in its entirety: U.S. patent application Ser. No. 10/963,369, filed Oct. 12, 2004, and titled "COPPER ELECTRODEPOSITION IN MICROELECTRONICS."

Figure 3:
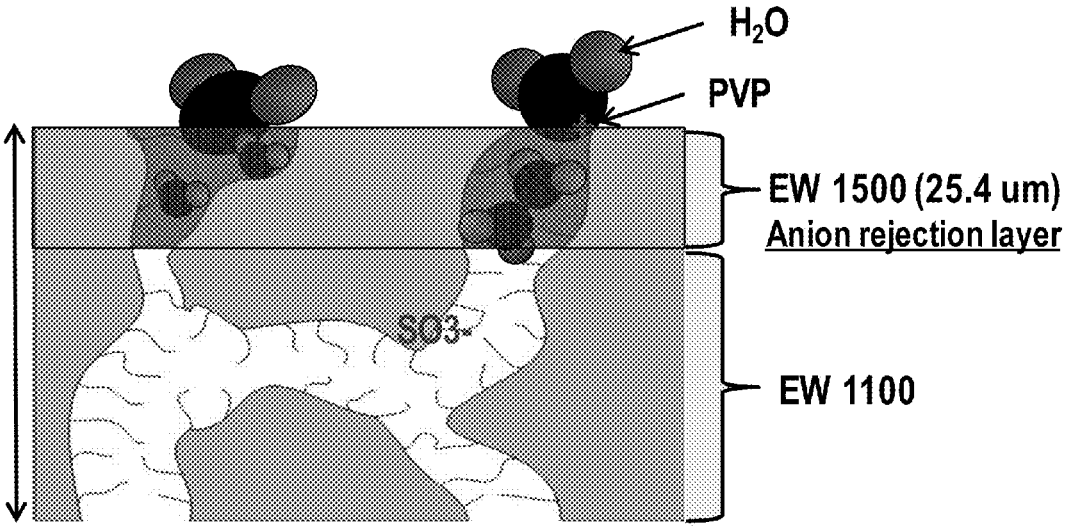
FIG. 3 illustrates a membrane becoming blocked with leveler species.

FIG. 3 shows a bilayer membrane structure which is becoming clogged with PVP. Both portions of this bilayer are made of cationic selective material such as NAFION®. The two layers have different equivalent weights (EWs) and densities. The top layer may be implemented as an anion rejection layer which is especially useful in ensuring that anions do not pass through the membrane. In this case, the top layer is positioned closer to a substrate and the bottom layer is positioned closer to an anode. Water molecules are strongly attracted to the PVP, especially to the oxygen in the PVP. Hydrogen bonding of the carbonyl group in PVP causes the nitrogen in the PVP to become fairly positive. The positively charged nitrogen in the PVP is electrostatically attracted to the negatively charged —$SO_3^-$ in the membrane. Because the PVP is on the order of about 1.5-9 nm estimated molecular radius, and the diameter of the pores in the membrane are about 1-4 nm (average 2.5 nm), the pores may become blocked with PVP. Note that the issue of clogging is not limited to bilayer membranes as shown in FIG. 3. Single layer structures may also experience clogging. Clogging can be a problem any time the pore diameter is similar to the additive diameter, and the pore charge is opposite that of the additive charge.

Multicomponent Membranes

In order to prevent the membrane from becoming blocked with charged species, a new type of multicomponent membrane may be used. One portion of the membrane may include an ion exchange layer such as a cation exchange membrane or anion exchange membrane, and the other portion of the membrane may include a charge separation layer that acts as a molecular weight cutoff and as a buffer between the ion exchange layer and charged species present in the anolyte or catholyte that are likely to clog the ion exchange layer. The charge separation layer is typically made from an uncharged material, and should be sufficiently thick to overcome the electrostatic attraction between charged species in the electrolyte and charged species in the ion exchange layer. In certain embodiments, the ion exchange layer may include two or more sublayers.

Figure 4:
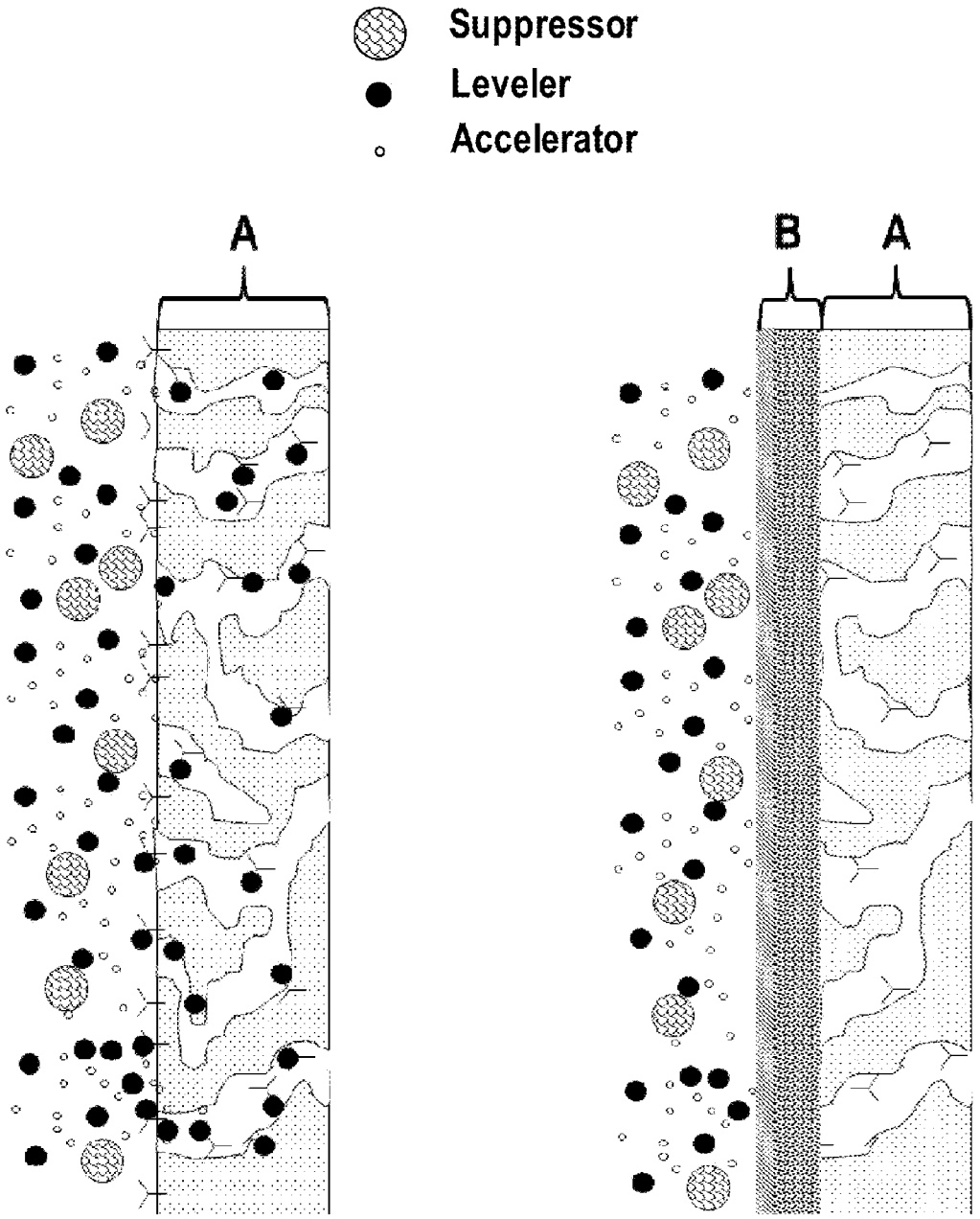
FIG. 4 shows a conventional cationic membrane (left panel) and an improved membrane having both a cationic selective layer and a charge separation layer (right panel) that are each exposed to catholyte.

FIG. 4 presents cross-sectional views of membranes. The membrane shown on the left represents a conventional ion exchange membrane such as one made from NAFION®. Leveler is able to penetrate into the pores of the membrane and cause the pores to become clogged. This undesirably raises the resistance of the membrane and can lead to the failure of an electroplating process. The membrane shown on the right side of FIG. 4 is constructed according to certain disclosed embodiments. The A portion of the membrane has ion permselectivity and may be, for example, an ion exchange layer (e.g., NAFION®). The B portion of the membrane is a charge separation layer (e.g., a filtration membrane or a conducting polymer layer). The charge separation layer shown in FIG. 4 includes two sub-layers, though this is not always the case. The two sub-layers are described further below in the Charge Separation Layer section. The charge separation layer acts as a physical barrier between the ion exchange layer and the species in electrolyte in order to minimize any electrostatic attraction between charged species in the electrolyte and charged groups in the ion exchange layer. The charge separation layer may also have a smaller pore size than the ion exchange layer, which may further reduce the amount of pore blockage. The small pore size may act as a molecular weight cutoff to prevent species that are too large from passing through to the ion exchange layer. With this improved multi-component membrane, the positively charged leveler species are too far away from the negatively charged groups in the ion exchange layer for the electrostatic attraction to be effective. Further, the small pore sizes may help prevent the passage of any leveler into the membrane.

In some designs, the multifunctional membranes described herein do not undergo an irreversible resistance increase of more than about 25% (or about 15%) when subjected to normal electroplating conditions and idle periods for the application under consideration. In some designs, the multifunctional membranes described herein maintain a resistance of about 0.0014 ohm/cm$^2$ of membrane sheet or lower, about 0.0013 ohm/cm$^2$ of membrane sheet or lower, about 0.0012 ohm/cm$^2$ of membrane sheet or lower, or about 0.001 ohm/cm$^2$ of membrane sheet or lower, even after relatively long periods of idle time in contact with electrolyte (e.g., 6 hours, or 12 hours, or 24 hours).

In certain embodiments, an electroplating process employs a multifunctional cation exchange membrane as described herein to separate an anolyte compartment from a catholyte compartment, where the catholyte compartment includes one or more organic additive molecules having a Lewis acid group and an effective diameter (when dissolved in catholyte) that is within about 50-150% of the average pore diameter of the cation exchange membrane portion of the multifunctional membrane.

Ion Exchange Layer

Membranes of the disclosed embodiments will typically include at least one ion exchange layer. This layer may be a cation exchange layer that permits passage of cations but not anions, or an anion exchange layer that permits passage of anions but not cations. The ion exchange layer will have an ion permselectivity.

As noted above, an ion exchange layer typically includes charged groups within the membrane including on the surfaces of the pores within the membrane. A cation exchange layer has negatively charged groups (e.g., —$SO_3^-$, —$COO^-$, —$PO_3^{2-}$, —$PO_3H^-$, —$C_6H_4O^-$, etc.), and an anion exchange layer has positively charged groups (e.g., —$NH_3^+$, —$NRH_2^+$, —$NR_2H^+$, —$NR_3^+$, —$SR_2^+$, etc.). One of the main purposes of the ion exchange layer is to prevent organic plating additives present in the catholyte from transferring to the anolyte, where they could come in contact with the anode and degrade. Ion exchange membranes used to separate anolyte and catholyte in an electroplating apparatus and methods for plating with such membranes are further discussed and described in the following U.S. Patents, each of which is herein incorporated by reference in its entirety: U.S. Pat. No. 6,527,920, titled "COPPER ELECTROPLATING METHODS AND APPARATUS"; U.S. Pat. No. 6,890,416, titled "COPPER ELECTROPLATING METHOD AND APPARATUS"; U.S. Pat. No. 6,821,407, titled "ANODE AND ANODE CHAMBER FOR COPPER ELECTROPLATING"; and U.S. Pat. No. 8,262,871, titled "PLATING METHOD AND APPARATUS WITH MULTIPLE INTERNALLY IRRIGATED CHAMBERS."

An ion exchange layer typically includes cross-linked linear polymer chains that form a three-dimensional network. Ion exchange materials may be tailored for specific applications. The pore size, charge density, and other properties may be tuned to meet particular requirements. Some vendors of ion exchange membrane offer brands having many different property combination options. Examples of ion exchange brands include NAFION® from DuPont of Wilmington, Del., Flemion® from Asahi Glass of Japan, NEOSEPTA-F® from Tokoyama Soda of Japan, and Gore Select® from W.L. Gore and Associates of Newark, N.J.

In some embodiments, the ion exchange layer may be implemented as two or more layers. The two or more layers may have different equivalent weights/densities. One of the ion exchange layers may act as an anion or cation exclusion layer.

In some embodiments, an ion exchange layer is between about 5-500 μm thick, for example between about 10-100 μm thick, or between about 25-50 μm thick. In a conventional ion exchange membrane, the layer is typically at least about 150 μm thick. However, much of this thickness is provided for the purpose of providing mechanical stability. In other words, the ion exchange membrane is still likely to function as needed even if it is provided in a much thinner layer than is used in conventional ion exchange membranes. The mechanical stability of the multicomponent membrane is enhanced by providing the ion exchange layer along with the charge separation layer.

Charge Separation Layer

The charge separation layer is provided for two main purposes. One purpose is to provide a physical barrier between charged species present in electrolyte and charged species present in an ion exchange layer. Another purpose is to provide a molecular weight cutoff such that relatively large species cannot enter the ion exchange layer.

Because the electrostatic attraction between the charged species decreases the farther these species are spaced apart, the physical barrier aspect of the charge separation layer is very effective in reducing the attraction between these charged species. One characteristic important in ensuring that the charge separation layer is effective is the thickness of this layer. In certain embodiments, the charge separation layer is at least about 150 μm thick, for example between about 150-1000 μm thick, or between about 150-500 μm thick, or between about 150-300 μm thick, or between about 150-200 μm thick. In many cases this thickness ensures that the electrostatic attraction between charged species in the electrolyte and charged species in the ion exchange layer is sufficiently low. As mentioned above, because the charge separation layer is provided together with the ion exchange layer, the thickness of the ion exchange layer may be relatively thin compared to a conventional ion exchange membrane used by itself.

The pore size or molecular weight cutoff value can affect the performance of the charge separation layer. In various embodiments, the charge separation layer has a smaller pore size than the ion exchange layer. In these or other cases, the charge separation layer may have an average pore size smaller than the average size of the species likely to adsorb onto the charge separation layer of the membrane. This helps prevent charged species and other large species from entering the ion exchange layer. In certain embodiments, the charge separation layer has average pore sizes that are about 1 nm or below.

Exemplary types of materials that may be used to construct a charge separation layer include filtration membrane materials and conducting polymer materials. Filtration membrane materials are porous polymer materials with molecular weight cut offs that are typically in the range of about 200-1500 Da, for example between about 200-1000 Da in some embodiments. In these or other embodiments, the charge separation layer has a MWCO of at least about 150 Da, or at least about 200 Da, or at least about 250 Da. The molecular weight cutoff should be lower than the molecular weight of the species that becomes trapped in the membrane. As used herein, the MWCO refers to the lowest molecular weight solute (in Da) in which 90% of the solute is retained by the membrane. In one example, the problem causing species is PVP having a molecular weight between about 3000-5000 Da, and the molecular weight cutoff value of the charge separation layer is between about 200-1000 Da. Typical materials used to fabricate a filtration membrane include are polysulfone (PS), poly(ether sulfone), poly(ether ether ketone) (PEEK), cellulose acetate (CA) and other cellulose esters, polyacrylonitrile (PAN), poly(vinylidene fluoride) (PVDF), polyimide (PI), poly(etherimide) (PEI), aliphatic polyamide (PA), polyethylene (PE), polypropylene (PP), polytetrafluoroethylene (PTFE, Teflon), and silicone. The material chosen for the charge separation layer should be able to withstand the conditions present in electrolyte. In many cases, the electrolyte is acidic (e.g., containing sulfuric acid, methanesulfonic acid, etc.), and the membrane in these embodiments should be capable of withstanding acidic solutions. In some cases, the pH of the electrolyte is between about 0.5-3, for example between about 1-2. The membrane may be hydrophilic in many cases.

The charge separation layer should also allow for sufficient flux through the membrane to promote good plating results. In some embodiments, the charge separation layer exhibits a permeation flux between about 25-75 L/($m^2$ hr), for example between about 40-60 L/($m^2$ hr) at standard conditions (e.g., 0° C. and 1 atm).

In one exemplary embodiment, the charge separation layer is made from a nanofiltration membrane referred to as MPF-34, which is available from Koch Membrane Systems of Wilmington, Mass. MPF-34 is a composite nanofiltration membrane. In certain embodiments, a nanofiltration membrane includes three layers, with a backing made of a polyolefin (e.g., a polypropylene/polyethylene blend). The intermediate and top polymeric layers of the membrane are made from distinct polymer materials. In certain embodiments, these polymer materials include a layer of a dense silicone-based material having a submicron thickness along with a layer of crosslinked polyacrylonitrile-based material provided for support. The silicone-based material may be a polydimethylsiloxane (PDMS) material. These polymeric organosilicon compounds are widely used and are known for their unusual rheological/flow properties. PDMS is optically clear, relatively inert, non-toxic, and non-flammable. It is sometimes referred to as dimethicone, and is one of several types of silicone oil (polymerized siloxane). Even where the charge separation layer is not made from an MPF-34 membrane, this layer may include a PDMS material, which may be provided in the form of a layer, and which may be provided with one or more additional polymeric or non-polymeric layers for support. The polyacrylonitrile-based material, where used, may be fairly fibrous and in certain embodiments is placed in contact with the ion exchange membrane. In these embodiments, a silicone-based material may face the electrolyte. These two layers may also be reversed such that the silicone-based material is in contact with the ion exchange layer and the polyacrylonitrile layer faces the electrolyte. The reported MWCO of MPF-34 is 200 Da (it rejects species greater than about 200 g/mol). More specifically, the MWCO measured at about 90% rejection is about 215 Da. The MPF-34 membrane does not contain charged functional groups, and has a pore size of about 1 nm or below. The membrane is stable through a wide variety of pH levels, up through a pH of at least about 14. The MPF-34 membrane used in the experiments described below had a thickness of about 10 mil (about 250 μm).

Filtration membranes are further discussed and described in "Nanofiltration Operations in Nonaqueous Systems" by L G Peeva, S Malladi, and A G Livingston of Imperial College London, London, UK, 2010, which is herein incorporated by reference in its entirety.

Exemplary conducting polymer materials include polyaniline (PANI), polypyrrole (PPy), Polyacetylene (PA), polythiophene (PTh), poly(3,4-ethylenedioxythiophene) (PEDOT), and Poly(phenyl vinlene) (PPV). The conducting polymers may or may not be doped. These materials may be used in combination with an ion exchange layer to provide a composite membrane according to certain embodiments.

Forming a Multicomponent Membrane

Membranes may be formed from one or more ion exchange layers in combination with one or more charge separation layers. The charge separation layer may be above or below the ion exchange layer, based on the ion exchange layer used and the charge and location of the adsorbing/blockage-causing species. Generally, the charge separation layer should be positioned in between the ion exchange layer and the electrolyte containing the blockage-causing species. In the context of a multicomponent membrane having a cationic exchange membrane with positively charged leveler in the catholyte, the charge separation layer should face the cathode and the cationic exchange layer should face the anode when installed in an electroplating cell. In some cases, a charge separation layer may be included both above and below an ion exchange layer, forming a sandwich type membrane. Also, as mentioned above, the ion exchange layer may be implemented as a series of two or more individual layers.

The layers of the multicomponent membrane may be fabricated in various ways. In one instance, the ion exchange layer is formed on top of a previously formed charge separation layer. In another instance, the charge separation layer is formed on top of a previously formed ion exchange layer. In yet another instance, a previously formed ion exchange layer and a previously formed charge separation layer are bonded together.

In order to deposit an ion exchange layer on top of a formed charge separation layer or to deposit a charge separation layer on top of a formed ion exchange layer, various fabrication options are available. Spray coating, spin coating, dip coating, brush coating, airbrushing, and electrospinning are example deposition techniques. In various embodiments the deposition involves spraying/spinning/dipping/brushing/etc. a solution onto a pre-formed layer and evaporating the liquid from the solution to form a second layer on the pre-formed layer. The pre-formed layer may be either the ion exchange layer or the charge separation layer. The solution will contain material used to form the other type of layer. The solution may include propanol or another easily evaporable liquid. After the second layer is deposited on the pre-formed layer, the structure may be annealed to form a more stable structure. In one embodiment, the membrane is annealed at a temperature of about 100-130° C. in combination with hot pressing to control the thickness of the membrane.

Where the two layers are formed separately and then bonded together, any type of bonding method may be used. In one embodiment, a layer of adhesive is applied to one or both of the ion exchange and charge separation layers. The layers may then be placed in contact with one another and the adhesive allowed to cure. In another embodiment, the layers are joined through a heat and/or pressure treatment. Care should be taken such that the membrane materials do not degrade during the fabrication process.

Figure 5:
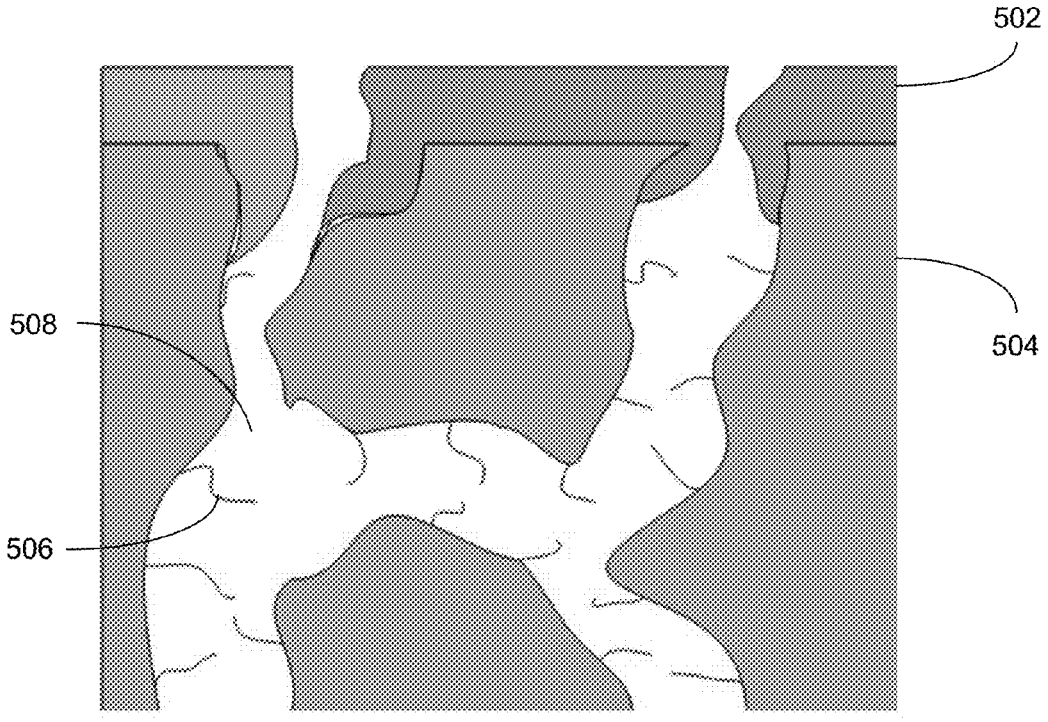
FIG. 5 illustrates an improved membrane that has a charge separation layer formed on a cationic selective layer.

FIG. 5 shows an embodiment of a multicomponent film having an upper charge separation layer 502 that was deposited on top of an ion exchange layer 504. In this case, the charge separation layer may extend into the ion exchange layer to some degree, as shown in FIG. 5. The pores 508 include polymer chains 506, which include charged species.

Performance of Multicomponent Membranes

Figure 6A:
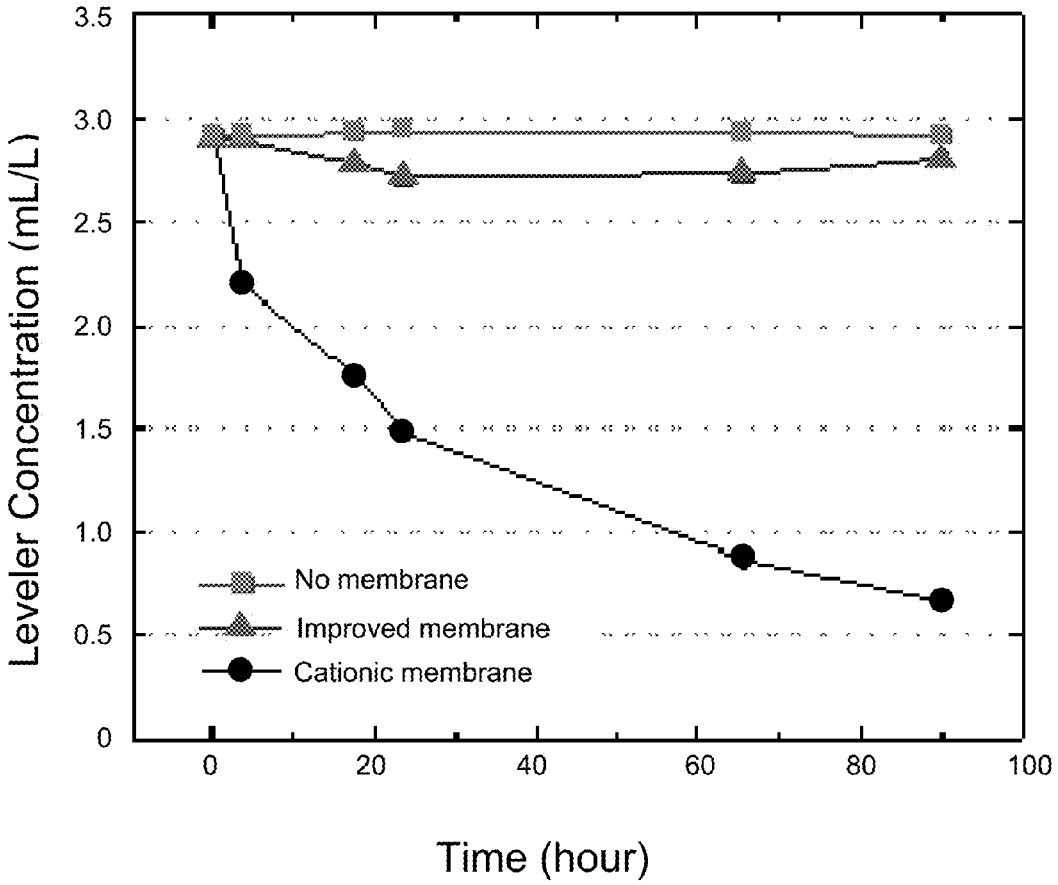
FIG. 6A depicts data related to the concentration of leveler over time in an idle electroplating solution where different (or no) membranes are present.

FIG. 6A shows a graph indicating the concentration of leveler over time in an electroplating solution in an electroplating apparatus having different types of membranes (or no membrane) separating the anolyte and catholyte. The electroplating apparatus was idle during the 90 hour testing period. In other words, no electroplating was actively occurring.

The data in FIG. 6A relates to the electroplating systems having the following types of membranes: a cationic NAFION® membrane (shown in circles), an improved membrane having both a cationic ion exchange layer and a charge separation layer (shown in triangles), and no membrane (shown in squares). In this experiment, a better performing membrane shows a smaller drop in leveler concentration over time. A smaller drop in leveler concentration means that less leveler is being trapped in the membrane. From these results, it is clear that the combination of an ion exchange membrane with a charge separation layer can be very successful in preventing leveler (or other similarly sized charged species) from adsorbing onto the membrane. In fact, the leveler concentrations are comparable between the improved membrane case and the no membrane case. The no membrane case provides a good baseline for comparing the results. Where no membrane is present, the leveler cannot become trapped in membrane pores, and any reduction in leveler concentration is unrelated to the membrane design. In the no membrane case, the concentration of leveler remains relatively stable, as shown in FIG. 6A. Where a conventional cationic ion exchange membrane is used, the leveler concentration drops from about 2.90 mL/L to about 0.67 mL/L over a time period of about 90 hours, representing a reduction of over 75%. In comparison, where the improved membrane is used, the leveler concentration shows a much smaller drop, from about 2.90 mL/L to about 2.84 mL/L, a reduction of only about 2%. These results suggest that the improved membrane may be used to help maintain bath concentrations at predictable and uniform levels, particularly during non-plating/idle periods. The results further show that such control is significantly harder where conventional membranes are used with species that can cause blockage.

In some embodiments, the concentration of leveler (or other adsorbing species) remains substantially constant (e.g., changes by less than about 10%) during periods in which the electroplating system is idle. For instance, over an idle period of about 1 hour, the concentration of leveler may drop by less than about 8%, for example less than about 5%. Over an idle period of about 5 hours, the concentration of leveler may drop by less than about 20%, for example less than about 10% or less than about 5%. Over an idle period of about 10 hours, the concentration of leveler may drop by less than about 30%, for example less than about 10% or less than about 5%. Over an idle period of about 24 hours, the concentration of leveler may drop by less than about 40%, for example less than about 20% or less than about 10%. This may be the case even where the leveler or other species is likely to adsorb onto the membrane (e.g., species having a charge/polarity opposite that in the membrane pores). In comparison, FIG. 6A shows that the conventional NAFION® membrane resulted in concentration level drops of about 10% over 1 hour, about 23% over 5 hours, about 33% over 10 hours, and about 50% over 24 hours.

Figure 6B:
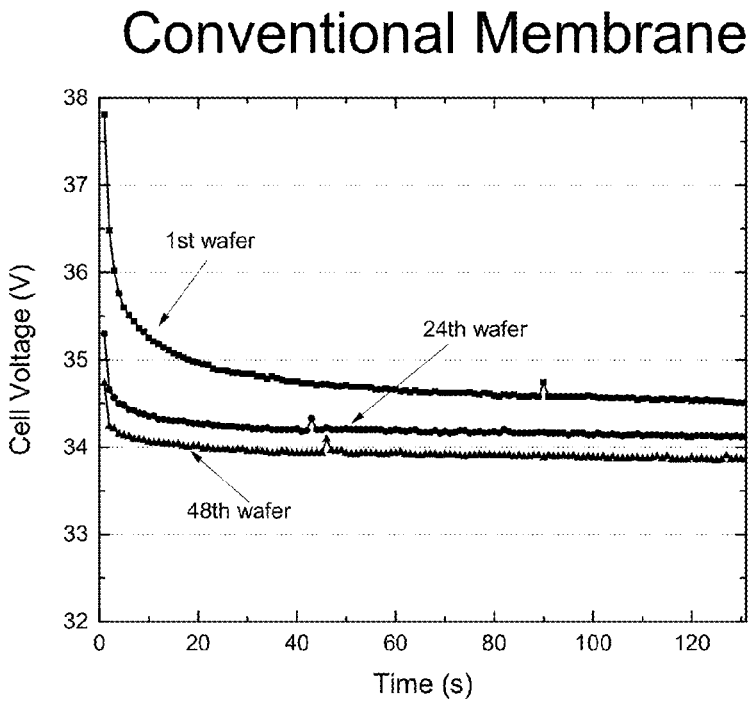
FIG. 6B shows data related to the voltage experienced during electroplating for a number of different wafers that were processed in chambers having conventional cationic membranes (top panel) and charge separation-type membranes (bottom panel).
Figure 6B:
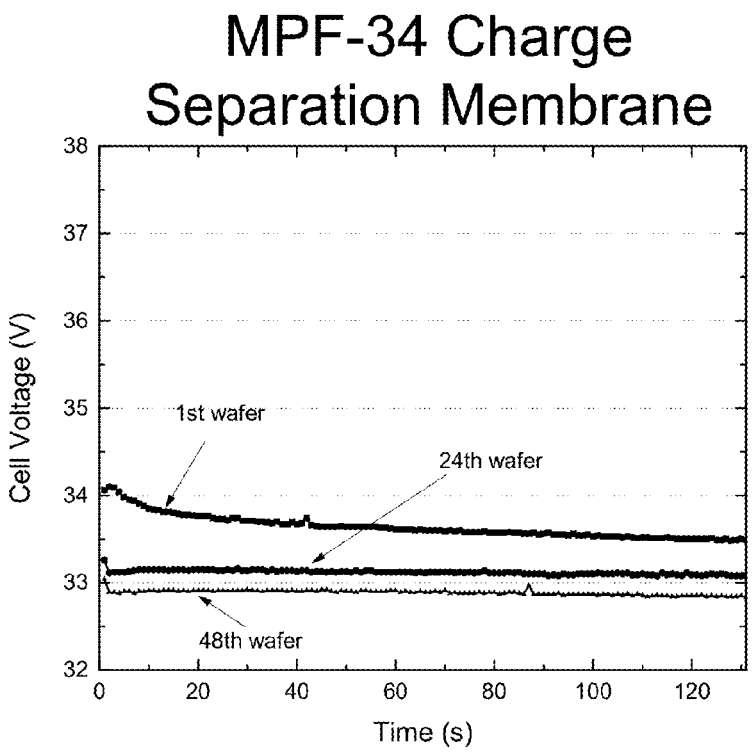

FIG. 6B presents data related to the cell voltage experienced over time during electroplating for a number of wafers processed in electrodeposition chambers having a conventional NAFION® membrane (top panel) and a charge separation layer-type membrane (MPF-34), without an ion exchange layer (bottom panel). For each membrane, a series of 48 wafers were tested. Data related to the first, last, and middle wafer processed are shown in the figure. Data for the other wafers are omitted for the sake of clarity. Before each wafer was tested, the electroplating apparatus was idle, with the relevant membrane present, for a period of about 12 hours. During this idle time (and during plating), the membranes were exposed to electrolyte containing PVP leveler. As such, the membranes had the opportunity to adsorb the leveler, as occurs during normal idle times for an electroplating apparatus that utilizes such a leveler.

The x-axis in each panel of FIG. 6B corresponds to the time over which electroplating occurred for each wafer. The y-axis in each graph corresponds to the cell voltage experienced during electroplating. In these experiments, wafers were electroplated for about 131 seconds at a current of about 40 A. The cell voltage tends to peak at the beginning of the experiment, when current at 40 A is first applied. In typical electroplating processes, these conditions may correspond to an overburden deposition stage where a relatively high current (e.g., 40 A) is used. The distribution of the peak voltage experienced during electroplating is much larger for the conventional membrane than for the charge separation membrane. The peak voltage in the conventional membrane case ranged from about 34.5-38 V. In contrast, the peak voltage in the charge separation membrane case ranged from about 33-34 V. This means that the voltage performance was much more uniform over the course of plating different wafers with the charge separation membrane. These results are further supported in FIGS. 6C and 6D, which specifically analyze the peak voltage experienced during electroplating for the experiments shown in FIG. 6B. In some embodiments, the voltage profile (the voltage over time) in the electroplating cell is substantially uniform between subsequent wafers. In the context of this application, this means that the peak voltage experienced during plating does not change by more than about 3% given the same electroplating conditions.

Figure 6C:
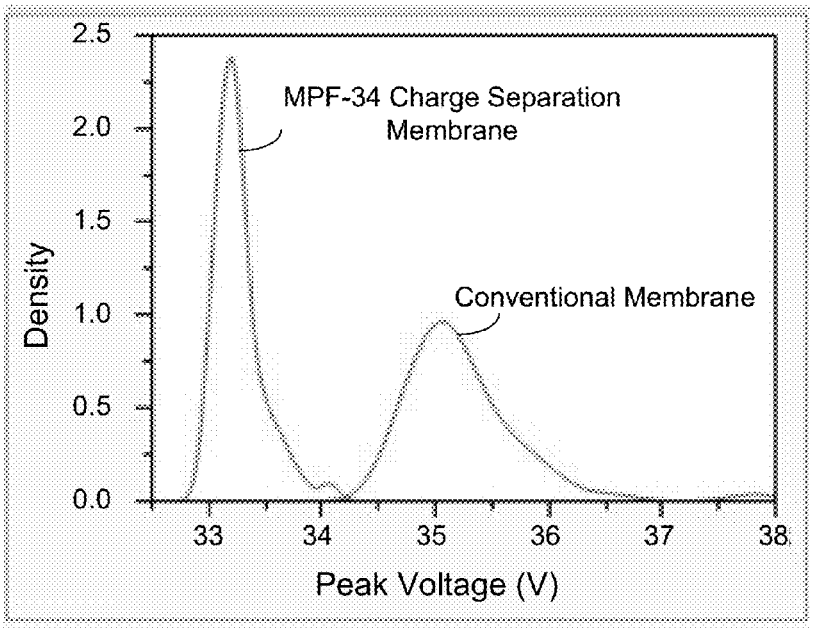
FIGS. 6C and 6D show data related to the distribution of peak voltage experienced during the electroplating experiments shown in FIG. 6B.
Figure 6D:
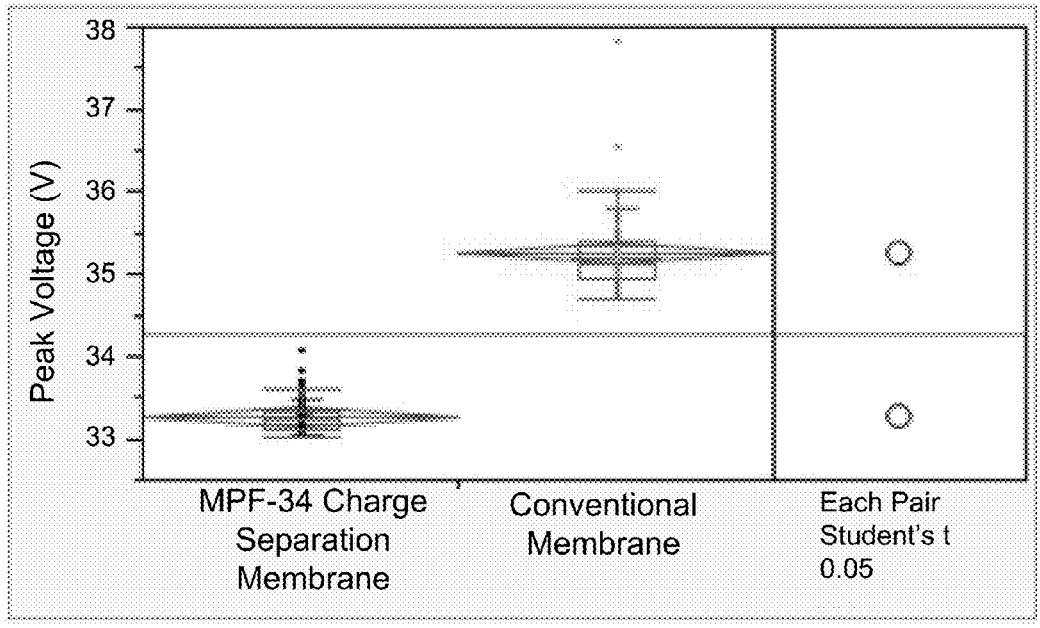

FIG. 6C is a graph depicting the distribution of the peak voltage for the conventional and charge separation membranes described with respect to FIG. 6B. The distribution of the peak voltage experienced where a charge separation membrane is used is narrower and centered around a slightly lower value. In contrast, the peak voltage experienced where a conventional membrane is used is significantly broader. FIG. 6D presents a box-and-whisker plot supporting this same finding.

Returning to the data shown in FIG. 6B, the cell voltage is especially high at the beginning of a plating process, particularly where the conventional membrane is used. This high peak voltage is expected due to the high resistance of the membrane that results after idle periods between processing wafers. During these idle periods, the PVP leveler has the opportunity to travel into and become lodged within the pores of the membrane. Over the course of plating a wafer, the PVP leveler may diffuse out of the membrane, degrade, become more conductive, or otherwise reduce its impact on the cell voltage experienced during plating, which may explain the drop in cell voltage over time for a single wafer. This effect is substantially reduced where the membrane includes a charge separation layer. This suggests that the charge separation layer may be used to effectively prevent a membrane from adsorbing leveler during idle periods. This PVP diffusion/breakdown/change in conductivity effect as wafers are plated may also explain the general downwards trend in cell voltage over time as new wafers are processed (the first wafer processed showing the highest cell voltage during plating and the last wafer processed showing the lowest cell voltage during plating). In other words, the membrane resistance is highest right after the long idle period at the beginning of plating, and decreases over time as more substrates are plated and the leveler diffuses out of the membrane.

Figure 6E:
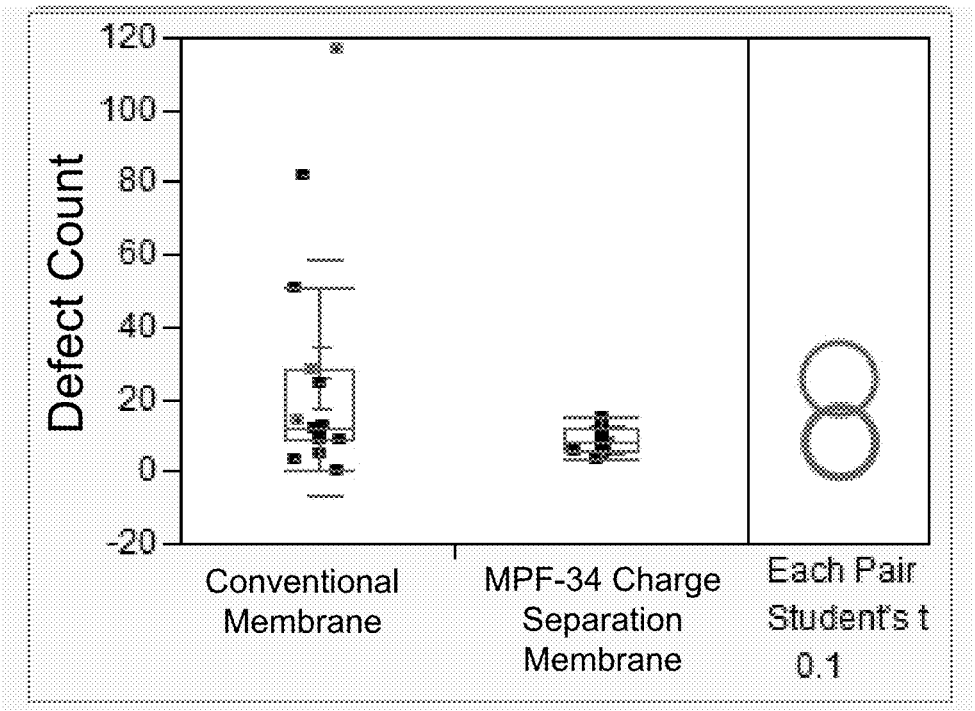
FIG. 6E presents data related to the number of defects detected on wafers plated in electroplating chambers having conventional cationic membranes and charge separation-type membranes.

FIG. 6E presents a box-and-whisker plot showing the number of defects observed on wafers plated with a conventional membrane made from NAFION®, and on wafers plated with an MPF-34 charge separation-type membrane. The results were obtained using a Surfscan® SP2 metrology tool from KLA-Tencor of Milpitas, Calif. This tool allows unpatterned wafer inspection with UV darkfield technology. Defects having a size between about 20-200 nm were recorded. The experiments were run on 300 mm wafers. The number of defects is higher and more variable in wafers plated in a chamber having a conventional membrane. In contrast, wafers plated in a chamber having a charge separation membrane show fewer defects, with a smaller variability in the number of defects observed. The advantages of the charge separation type membrane, as related to FIGS. 6B-6E, arise because the potentially adsorbing species (e.g., PVP leveler) do not become adsorbed in the membrane during idle times, in contrast with the conventional NAFION® membrane. These advantages are expected to carry over to cases where a charge separation layer is used in combination with an ion exchange layer, so long as the charge separation layer is positioned adjacent the electrolyte containing the potentially adsorbing species (usually but not necessarily the catholyte).

The methods described herein may be performed by any suitable electroplating apparatus having an anode and cathode separated by a membrane as described above. A suitable apparatus includes hardware for accomplishing electroplating process operations and a system controller having instructions for controlling process operations. For example, in some embodiments, the hardware may include one or more process stations included in a process tool.

Figure 7:
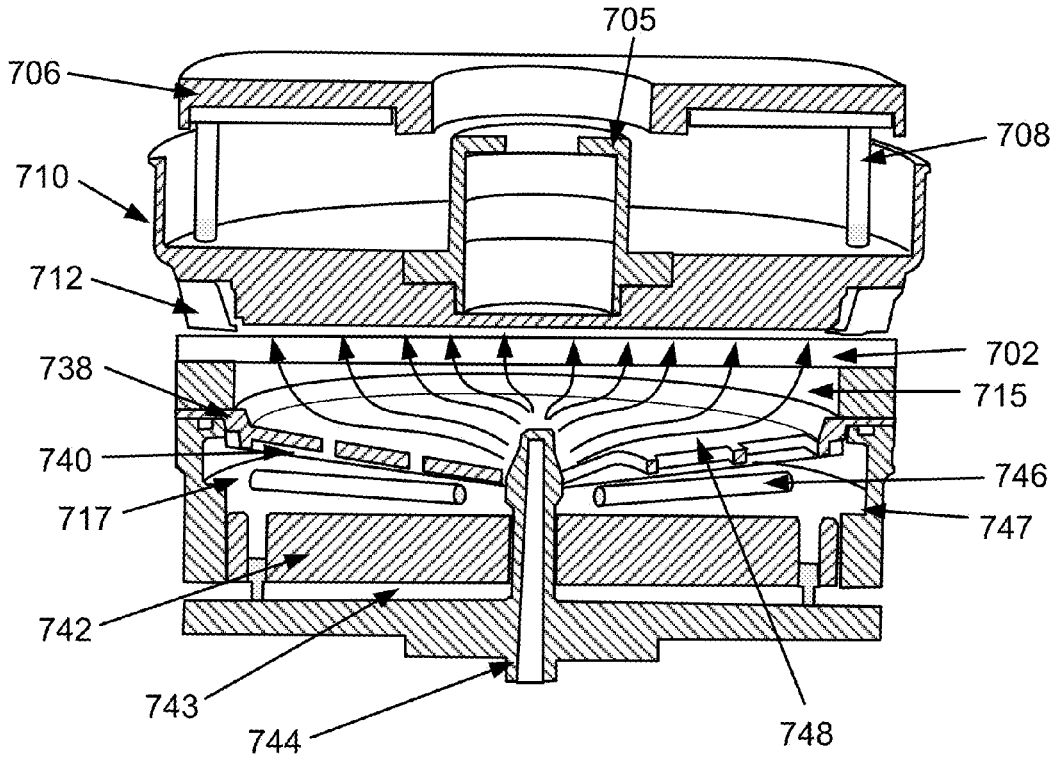
FIG. 7 shows an electroplating apparatus according to a disclosed embodiment.

FIG. 7 shows an electroplating cell and substrate holder that may be used in practicing the embodiments herein. As shown, the electroplating cell includes an upper or cathode chamber 715 defined in part by a circular wall. The upper catholyte chamber 715 and lower anode chamber 717 of the cell are separated by a membrane 740 and an inverted conically shaped support structure 738, sometimes referred to as a membrane frame. The flow lines 748 indicate the flow path of the electrolyte up to and through the optional flow shaping plate 702. The anode chamber 717 includes an anode 742 and a charge plate 743 for delivering power to the anode 742. The anode chamber 717 may also include an inlet manifold 747 and a series of flutes 746 for delivering anolyte to the anode surface in a manner that irrigates the top surface of the anode 742. Passing through the center of the anode 742 and the anode chamber 717 is a catholyte flow inlet 744. This structure delivers catholyte to upper chamber 715 along streamlines 748 as shown by the radial/vertical arrows in FIG. 7.

The substrate holder is positioned above the cathode chamber 715, and is capable of moving up and down, as well as rotating. The substrate is supported by cup 712. A top plate 706 may be used for connecting to the cup 712 and for allowing the cup 712 to move up and down to hold the wafer in position against a cone 710. Struts 708 connect cup 712 to top plate 706. Mounted to cone 710 is a housing 705 that holds various connections such as pneumatic and electrical connections. The cone 710 may also include a cut out to produce a flexible cantilever structure in the cone, and a sealing O-ring. The cup 712 may include a main cup body or structure, electrical contacts for connecting with the substrate, a bus plate for delivering electricity to the contacts, and a cup bottom, which defines a lower surface of the substrate holder assembly.

One of ordinary skill in the art would understand that a variety of reactor designs may be used in practicing the techniques disclosed herein. Suitable electroplating cell designs are further discussed and described in U.S. patent application Ser. No. 13/172,642, filed Jun. 29, 2011, and titled "CONTROL OF ELECTROLYTE HYDRODYNAMICS FOR EFFICIENT MASS TRANSFER DURING ELECTROPLATING," U.S. patent application Ser. No. 13/305,384, filed Nov. 28, 2011, and titled "ELECTROPLATING APPARATUS AND PROCESS FOR WAFER LEVEL PACKAGING," and U.S. patent application Ser. No. 13/893,242, filed May 13, 2013, and titled "CROSS FLOW MANIFOLD FOR ELECTROPLATING APPARATUS," each of which is incorporated by reference herein in its entirety.

Figure 8:
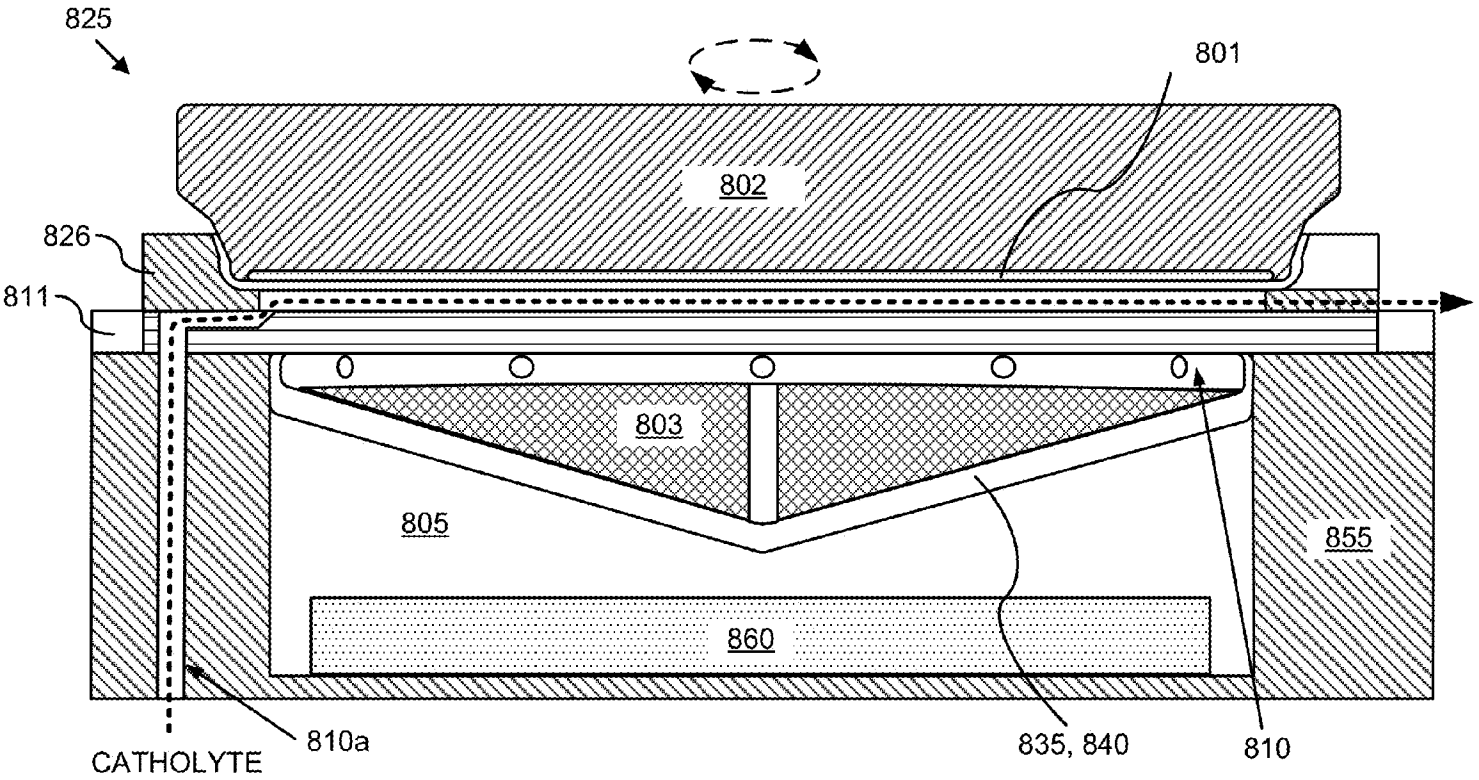
FIG. 8 shows an electroplating apparatus according to another disclosed embodiment.

FIG. 8 shows an additional embodiment of an electroplating apparatus 825 that may be used to practice the disclosed embodiments. Highlighted in this embodiment is a cross flow inlet 810*a* which delivers catholyte to the cathode chamber 803 above the flow shaping plate 811 and below the substrate 801, which is supported by substrate holder 802. Also highlighted in this embodiment is a flow diverter 826, which is positioned above the flow shaping plate 811, and which acts to confine the flow near the substrate. The flow diverter 826 includes a gap in one side of the diverter, such that fluid may exit through the gap. The gap in the flow diverter 826 is positioned opposite the cross flow inlet 810*a*. This configuration provides substantial catholyte cross flow (i.e., shearing force) over the surface of the substrate 801.

Apparatus 825 includes a plating cell, 855, which is dual chamber cell, having an anode chamber 805 housing anode 860 and anolyte. The anode chamber 805 and cathode chamber 803 are separated by membrane 840 as described herein, which is supported by a support member 835. Plating apparatus 825 includes a flow shaping plate, 811. A flow diverter, 826, is positioned on top of flow shaping plate 811, and aides in creating transverse shear flow. Catholyte is introduced into the cathode chamber 803 (above membrane 840) via flow ports 810. From flow ports 810, catholyte passes through the holes in flow shaping plate 811 and produces impinging flow onto the plating surface of the wafer 801. After impinging upon the substrate 801, the flow originating from the channels in the flow shaping plate 811 changes direction such that it flows laterally over the surface of the substrate, in the same direction as the cross flow originating from the cross flow inlet 810*a*. In this example, the cross flow inlet 810*a* is (at least partially) formed as a channel in flow shaping plate 811. The functional result is that catholyte flow is introduced directly into the pseudo chamber formed between the flow shaping plate 811 and the wafer plating surface 801 in order to enhance transverse flow across the wafer surface and thereby normalize the flow vectors across the wafer 801 (and flow plate 811). While various elements shown in FIG. 8 are not necessary for practicing the disclosed embodiments, these elements (e.g., cross flow inlet 810*a*, flow shaping plate 811 and flow diverter 826) may be included to improve uniformity and other aspects of the plating results.

Figure 9:
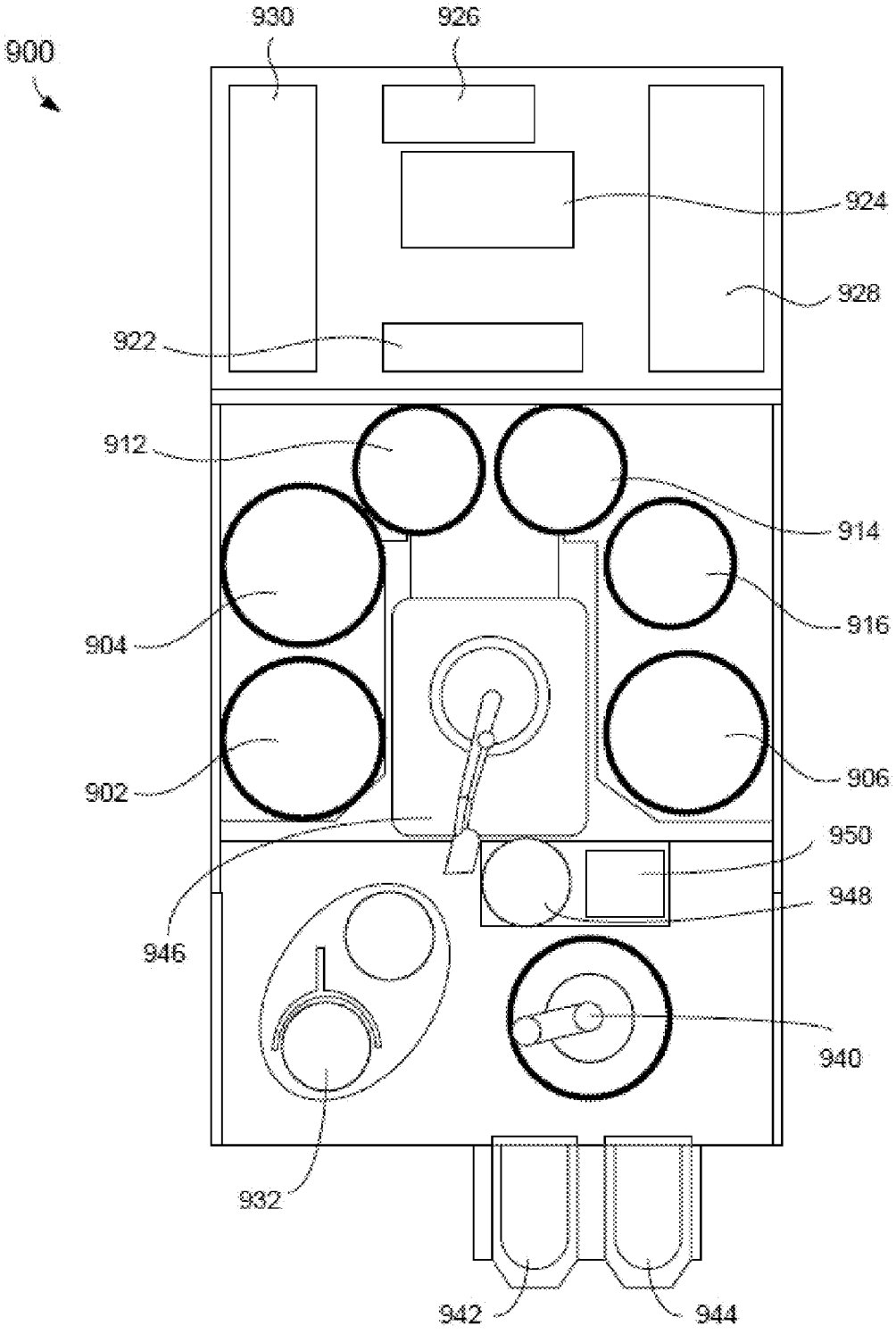
FIGS. 9 and 10 illustrate top-down views of multi-tool electroplating apparatus according to certain embodiments.

FIG. 9 shows an exemplary multi-tool apparatus that may be used to implement the embodiments herein. The electrodeposition apparatus 900 can include three separate electroplating modules 902, 904, and 906. The electroplating modules 902, 904 and 906 may be equipped with anode and cathode chambers separated by a membrane. Further, three separate modules 912, 914 and 916 may be configured for various process operations. For example, in some embodiments, one or more of modules 912, 914 and 916 may be a spin rinse drying (SRD) module. In other embodiments, one or more of the modules 912, 914 and 916 may be post-electrofill modules (PEMs), each configured to perform a function, such as edge bevel removal, backside etching, and acid cleaning of substrates after they have been processed by one of the electroplating modules 902, 904, and 906.

The electrodeposition apparatus 900 includes a central electrodeposition chamber 924. The central electrodeposition chamber 924 is a chamber that holds the chemical solution used as the electroplating solution in the electroplating modules 902, 904, and 906. The central electrodeposition chamber 924 may be separated into two separate sub-chambers for holding anolyte and catholyte separately. The electrodeposition apparatus 900 also includes a dosing system 926 that may store and deliver additives or other solutions to the electroplating solutions. A chemical dilution module 922 may store and mix chemicals to be used as, for example, an electrolyte and/or etchant. A filtration and pumping unit 928 may filter the electroplating solutions delivered to/from the central electrodeposition chamber 924 and pump the solutions to the electroplating modules 902, 904 and 906.

A system controller 930 provides electronic and interface controls required to operate the electrodeposition apparatus 900. The system controller 930 (which may include one or more physical or logical controllers) controls some or all of the properties of the electroplating apparatus 900. The system controller 930 typically includes one or more memory devices and one or more processors. The processor may include a central processing unit (CPU) or computer, analog and/or digital input/output connections, stepper motor controller boards, and other like components. Instructions for implementing appropriate control operations as described herein may be executed on the processor. These instructions may be stored on the memory devices associated with the system controller 930 or they may be provided over a network. In certain embodiments, the system controller 930 executes system control software.

The system control software in the electrodeposition apparatus 900 may include instructions for controlling the timing of the electroplating process, delivery/composition of electrolyte components, plating cell pressure, plating cell temperature, substrate temperature, current and potential applied to the substrate and any other electrodes, substrate position, substrate rotation, and other parameters of a particular process performed by the electrodeposition apparatus 900.

System control logic may be configured in any suitable way. For example, various process tool component subroutines or control objects may be written to control operation of the process tool components necessary to carry out various process tool processes. System control software may be coded in any suitable computer readable programming language. The logic may also be implemented as hardware in a programmable logic device (e.g., an FPGA), an ASIC, or other appropriate vehicle.

In some embodiments, system control logic includes input/output control (IOC) sequencing instructions for controlling the various parameters described above. For example, each phase of an electroplating process may include one or more instructions for execution by the system controller 930. The instructions for setting process conditions for an immersion process phase may be included in a corresponding immersion recipe phase. In some embodiments, the electroplating recipe phases may be sequentially arranged, so that all instructions for an electroplating process phase are executed concurrently with that process phase.

The control logic may be divided into various components such as programs or sections of programs in some embodiments. Examples of logic components for this purpose include a substrate positioning component, an electrolyte composition control component, a solution flow control component, a pressure control component, a heater control component, and a potential/current power supply control component. The controller may execute the substrate positioning component by, for example, directing the substrate holder to move (rotate, lift, tilt) as desired. The controller may control the composition and flow of various fluids (including but not limited to electrolyte and stripping solution) by directing certain valves to open and close at various times during processing. The controller may execute the pressure control program by directing certain valves, pumps and/or seals to be open/on or closed/off. Similarly, the controller may execute the temperature control program by, for example, directing one or more heating and/or cooling elements to turn on or off. The controller may control the power supply by directing the power supply to provide desired levels of current/potential throughout processing.

In some embodiments, there may be a user interface associated with the system controller 930. The user interface may include a display screen, graphical software displays of the apparatus and/or process conditions, and user input devices such as pointing devices, keyboards, touch screens, microphones, etc.

In some embodiments, parameters adjusted by the system controller 930 may relate to process conditions. Non-limiting examples include solution conditions (temperature, composition, and flow rate), substrate position (rotation rate, linear (vertical) speed, angle from horizontal) at various stages, etc. These parameters may be provided to the user in the form of a recipe, which may be entered utilizing the user interface.

Signals for monitoring the process may be provided by analog and/or digital input connections of the system controller 930 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

In one embodiment of a multi-tool apparatus, the instructions can include inserting the substrate in a wafer holder, tilting the substrate, biasing the substrate during immersion, electrodepositing material on the substrate, and maintaining the composition of anolyte and catholyte within pre-defined ranges.

A hand-off tool 940 may select a substrate from a substrate cassette such as the cassette 942 or the cassette 944. The cassettes 942 or 944 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 940 may hold the substrate using a vacuum attachment or some other attaching mechanism.

The hand-off tool 940 may interface with a wafer handling station 932, the cassettes 942 or 944, a transfer station 950, or an aligner 948. From the transfer station 950, a hand-off tool 946 may gain access to the substrate. The transfer station 950 may be a slot or a position from and to which hand-off tools 940 and 946 may pass substrates without going through the aligner 948. In some embodiments, however, to ensure that a substrate is properly aligned on the hand-off tool 946 for precision delivery to an electroplating module, the hand-off tool 946 may align the substrate with an aligner 948. The hand-off tool 946 may also deliver a substrate to one of the electroplating modules 902, 904, or 906, or to one of the separate modules 912, 914 and 916 configured for various process operations.

An apparatus configured to allow efficient cycling of substrates through sequential plating, rinsing, drying, and PEM process operations may be useful for implementations for use in a manufacturing environment. To accomplish this, the module 912 can be configured as a spin rinse dryer and an edge bevel removal chamber. With such a module 912, the substrate would only need to be transported between the electroplating module 904 and the module 912 for plating and EBR operations.

Figure 10:
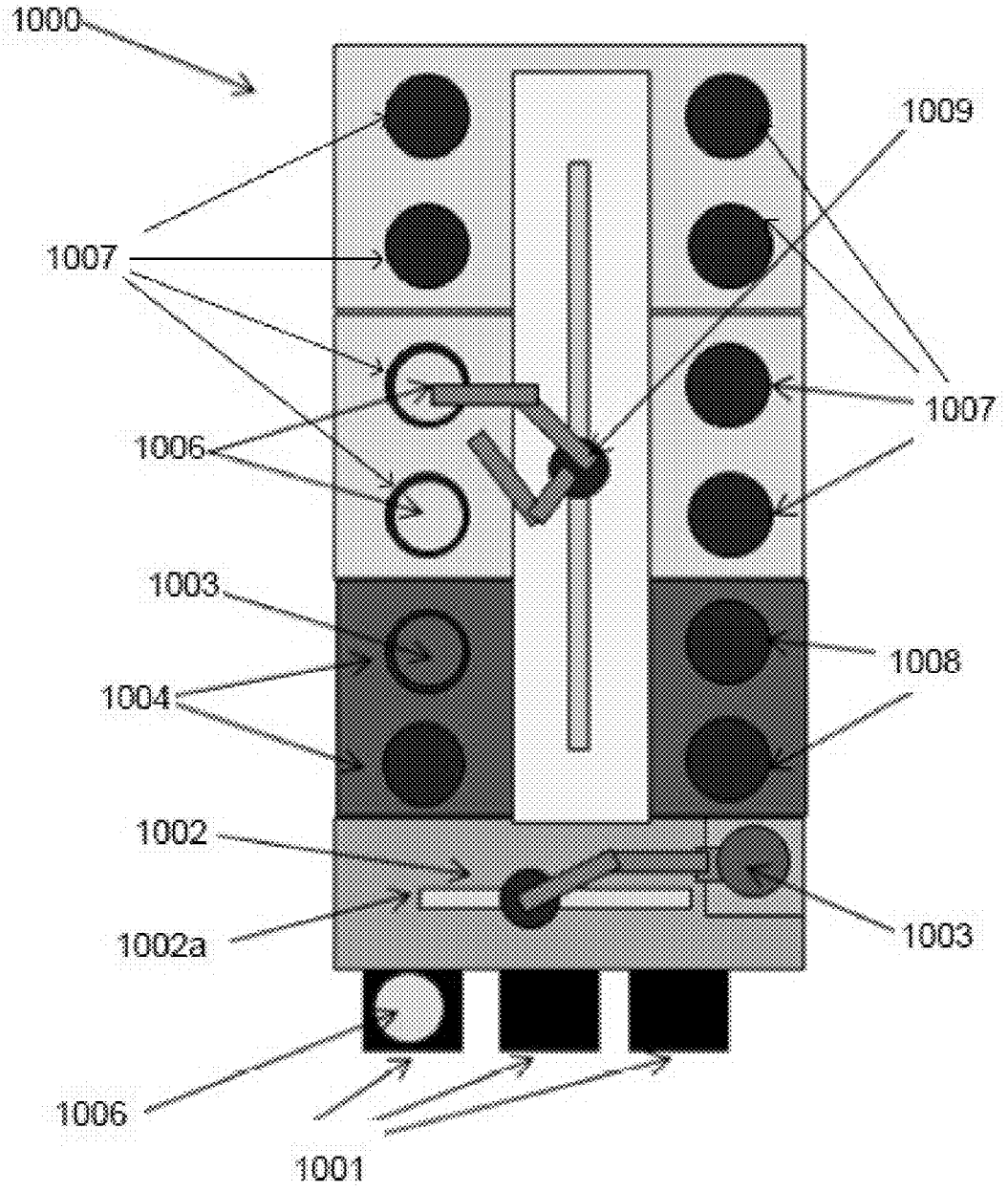

FIG. 10 shows an additional example of a multi-tool apparatus that may be used in implementing the embodiments herein. In this embodiment, the electrodeposition apparatus 1000 has a set of electroplating cells 1007, each containing an electroplating bath, in a paired or multiple "duet" configuration. In addition to electroplating per se, the electrodeposition apparatus 1000 may perform a variety of other electroplating related processes and sub-steps, such as spin-rinsing, spin-drying, metal and silicon wet etching, electroless deposition, pre-wetting and pre-chemical treating, reducing, annealing, photoresist stripping, and surface pre-activation, for example. The electrodeposition apparatus 1000 is shown schematically looking top down, and only a single level or "floor" is revealed in the figure. However, it is to be readily understood by one having ordinary skill in the art that such an apparatus, e.g. the Lam Research Sabre™ 3D tool, can have two or more levels "stacked" on top of each other, each potentially having identical or different types of processing stations.

Referring once again to FIG. 10, the substrates 1006 that are to be electroplated are generally fed to the electrodeposition apparatus 1000 through a front end loading FOUP 1001 and, in this example, are brought from the FOUP to the main substrate processing area of the electrodeposition apparatus 1000 via a front-end robot 1002 that can retract and move a substrate 1006 driven by a spindle 1003 in multiple dimensions from one station to another of the accessible stations—two front-end accessible stations 1004 and also two front-end accessible stations 1008 are shown in this example. The front-end accessible stations 1004 and 1008 may include, for example, pre-treatment stations, and spin rinse drying (SRD) stations. Lateral movement from side-to-side of the front-end robot 1002 is accomplished utilizing robot track 1002*a*. Each of the substrates 1006 may be held by a cup/cone assembly (not shown) driven by a spindle 1003 connected to a motor (not shown), and the motor may be attached to a mounting bracket 1009. Also shown in this example are the four "duets" of electroplating cells 1007, for a total of eight electroplating cells 1007. A system controller (not shown) may be coupled to the electrodeposition apparatus 1000 to control some or all of the properties of the electrodeposition apparatus 1000. The system controller may be programmed or otherwise configured to execute instructions according to processes described earlier herein.

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. An apparatus for electroplating material onto a substrate, comprising:

a reaction vessel comprising a cathode chamber and an anode chamber, the cathode chamber configured to hold catholyte during electroplating and the anode chamber configured to hold anolyte and an anode during electroplating;

a membrane in the reaction vessel separating the cathode chamber from the anode chamber, the membrane comprising an ion exchange layer and a charge separation layer, wherein the charge separation layer is at least about 150 μm thick, and wherein the membrane has a molecular weight cut off between about 200-1500 Da; and a substrate support mechanism for supporting the substrate in the reaction vessel such that the substrate is exposed to the catholyte in the cathode chamber during electroplating.

2. The apparatus of claim 1, wherein the charge separation layer is between about 150-1000 μm thick.

3. The apparatus of claim 1, wherein the charge separation layer has a molecular weight cutoff between about 200-1000 Da.

4. The apparatus of claim 1, wherein the charge separation layer has an average pore diameter of about 1 nm or less.

5. The apparatus of claim 1, wherein the charge separation layer comprises one or more of the materials from the group consisting of: polysulfone, polyethersulfone, polyetheretherketone, cellulose acetate, cellulose ester, polyacrylonitrile, polyvinylidene fluoride, polyimide, polyetherimide, aliphatic polyamide, polyethylene, polypropylene, polytetrafluoroethylene, and silicone.

6. The apparatus of claim 1, wherein the charge separation layer is stable in acidic electrolyte.

7. The apparatus of claim 1, wherein the charge separation layer comprises a nanofiltration material.

8. The apparatus of claim 7, wherein the charge separation layer comprises MPF-34.

9. The apparatus of claim 1, wherein the ion exchange layer is between about 10-100 μm thick.

10. The apparatus of claim 1, wherein the charge separation layer faces the cathode chamber and the ion exchange layer faces the anode chamber.

11. The apparatus of claim 1, the membrane further comprising a second charge separation layer, wherein the charge separation layer contacts a first side of the ion exchange layer and wherein the second charge separation layer contacts a second side of the ion exchange layer, such that the membrane has a sandwich structure.

12. A method of electroplating material onto a substrate, comprising:

providing a substrate in a reaction vessel comprising a cathode chamber, an anode chamber, and a membrane separating the cathode chamber from the anode chamber, wherein the membrane comprises an ion exchange layer and a charge separation layer, wherein the charge separation layer is at least about 150 μm thick, and has a molecular weight cutoff between about 200-1500 Da, and wherein the substrate contacts catholyte in the cathode chamber; and electroplating material onto the substrate.

13. The method of claim 12, wherein the ion exchange layer comprises pores having an average diameter, the surface of the pores comprising positively or negatively charged groups, and wherein at least one of the anolyte and catholyte comprises an adsorbing species having a charge that is opposite the charge of the charged groups in the pores, the adsorbing species having an average molecular diameter between about 50-150% of the average diameter of the pores.

14. The method of claim 13, wherein the adsorbing species comprises a leveler.

15. The method of claim 14, wherein the leveler comprises polyvinylpyrrolidone and the charged groups on the surface of the pores comprise $SO_3^-$.

16. The method of claim 15, wherein the charge separation layer faces the cathode chamber, and wherein the ion exchange layer faces the anode chamber.

17. The method of claim 12, further comprising repeating the method to electroplate material onto a plurality of substrates, wherein there is an idle period between electroplating sub sequent substrates.

18. The method of claim 17, wherein a voltage profile during electroplating is substantially uniform between subsequent substrates.

19. The method of claim 17, wherein the idle period between electroplating subsequent substrates is at least about 6 hours, and wherein a resistance of the membrane does not increase by more than about 25% during the idle period.

20. The method of claim 17, wherein the ion exchange layer comprises pores comprising charged groups, wherein at least one of the anolyte and catholyte comprises an adsorbing species having a charge that is opposite the charge of the charged groups in the pores, wherein the idle period between electroplating subsequent substrates is at least about 1 hour, and wherein a concentration of adsorbing species in the anolyte or catholyte does not decrease by more than about 8% during the idle period.

21. A method of idling an electrodeposition apparatus, comprising:

idling an electrodeposition apparatus comprising:

a reaction vessel comprising a cathode chamber, an anode chamber, and a membrane separating the cathode chamber from the anode chamber, wherein the membrane comprises an ion exchange layer and a charge separation layer, the charge separation layer having a thickness of at least about 150 μm and a molecular weight cutoff between about 200-1500 Da, and wherein the cathode chamber comprises catholyte and the anode chamber comprises anolyte.

22. The method of claim 21, wherein the ion exchange layer comprises pores having an average diameter, the surface of the pores comprising positively or negatively charged groups, and wherein at least one of the anolyte and catholyte comprises an adsorbing species having a charge that is opposite the charge of the charged groups in the pores, the adsorbing species having an average molecular diameter between about 50-150% of the average diameter of the pores.

23. The method of claim 21, wherein after idling for a period of at least about 6 hours, a resistance of the membrane does not increase by more than about 25%.

* * * * *